US005725161A

United States Patent [19]

Hartle

[11] Patent Number: 5,725,161

[45] Date of Patent: Mar. 10, 1998

[54] ELECTROSTATIC COATING SYSTEM INCLUDING IMPROVED SPRAY GUN FOR CONDUCTIVE PAINTS

[75] Inventor: Ronald J. Hartle, Amherst, Ohio

[73] Assignee: Nordson Corporation, Westlake, Ohio

[21] Appl. No.: 395,808

[22] Filed: Feb. 28, 1995

[51] Int. Cl.[6] ..... B05B 5/00

[52] U.S. Cl. ..... 239/690; 239/690.1; 141/192; 118/629

[58] Field of Search ..... 239/690, 690.1, 239/691, 297, 300; 141/18, 21, 192; 118/506, 629; 138/149, 137, 141, 146

[56] References Cited

U.S. PATENT DOCUMENTS

| | | | |
|---|---|---|---|
| 3,606,972 | 9/1971 | Ferrant | 239/609.1 |
| 3,746,254 | 7/1973 | Duncan et al. . | |
| 4,221,239 | 9/1980 | Reale | 138/149 |
| 4,313,475 | 2/1982 | Wiggins | 239/691 X |
| 4,544,100 | 10/1985 | Simashkevich et al. . | |
| 5,271,569 | 12/1993 | Konieczynski et al. . | |
| 5,322,221 | 6/1994 | Anderson | 239/300 |

OTHER PUBLICATIONS

Publication entitled "The DEIMOS–Electrostatic System", by Bollhoff Verfahrenstechnik, publication date unknown but prior to Jan. 27, 1995.

*Primary Examiner*—Robert J. Oberleitner
*Assistant Examiner*—Pamela J. Lipka
*Attorney, Agent, or Firm*—Tarolli, Sundheim, Covell, Tummino & Szabo

[57] ABSTRACT

An electrostatic coating system includes an electrically nonconductive coating material tube is disposed in an electrically conductive handle portion of the spray gun and extends into an electrically nonconductive barrel or extension portion of the spray gun. The coating material tube is preformed to and maintains a configuration corresponding to a configuration of a passage in the handle and extension portions of the spray gun. A packing cartridge is connected between the trigger and the spray gun valve and has a tapered end portion which is encircled by an O-ring seal which engages a tapered bore in the extension portion of the spray gun. The handle portion of the spray gun is grounded through a conductive inner layer of an air conduit connected to the spray gun. An atomizing air passage extends from the handle portion of the spray gun through the extension portion to the nozzle. A pattern air passage also extends from the handle portion through the extension portion to the nozzle. Thumb wheel operated air flow control valve assemblies are located in the atomizing air and pattern air passages.

52 Claims, 7 Drawing Sheets

ELECTROSTATIC COATING SYSTEM INCLUDING IMPROVED SPRAY GUN FOR CONDUCTIVE PAINTS

BACKGROUND OF THE INVENTION

The present invention relates to a system for use in applying coating material to an object and more specifically to a system which includes a spray gun which is utilized to direct electrically conductive coating material which is electrostatically charged, toward the object.

A known system for use in applying coating material to an object includes a spray gun which electrostatically charges the coating material and directs the coating material toward the object. The known spray gun has a handle portion containing a high-voltage transformer. The high-voltage transformer is connected with a charging electrode through a high-voltage cascade which is mounted on a barrel portion of the spray gun.

During use of this known spray gun, the electrode electrostatically charges a flow of liquid coating material conducted through a nozzle. The flow of liquid coating material from the nozzle is atomized by a flow of atomizing air through a passage in the barrel of the spray gun. The flow of atomized coating material is shaped to have a desired configuration by a flow of pattern air which is conducted through the barrel of the spray gun to outlets in the nozzle.

A main flow control valve in the handle of this known spray gun controls the flow of both atomizing air and pattern air. A regulator valve on the handle portion of the spray gun is operable to adjust the flow of atomizing air. A second regulator valve, at the outer end of the barrel portion of the spray gun, is operable to adjust the flow of pattern air.

In order to minimize operator fatigue, a spray gun should be as light as possible. Of course, the provision of a high-voltage transformer and related equipment in the known spray gun increases the weight of the spray gun. In addition, where electrically conductive coating material is used, such as water borne paints, it is necessary to protect the operator from electric shock. Thus, a light weight spray gun which protects the operator from the hazards of electric shocks is needed.

SUMMARY OF THE INVENTION

The present invention provides a new and improved system for use in applying electrostatically charged electrically conductive coating material to an object. The system includes a relatively light weight spray gun having an electrically conductive handle portion. An inflexible fluid tube, that is, a fluid tube which retains a preformed shape, may advantageously be provided in the handle portion. The fluid tube conducts a flow of electrostatically charged coating material through the handle portion while maintaining the coating material electrically insulated from the handle portion to protect the operator from electric shock. The handle portion may be connected with an electrical ground through a layer of electrically conductive material inside an air conduit connected with the handle portion. The electrostatic efficiency of the coating system may be increased by providing a floating field electrode in the nozzle of the spray gun.

The spray gun may advantageously be constructed with a pair of air passages, that is one passage to conduct air to atomize a flow of coating material and a second passage to conduct air to shape the flow of atomized coating material to a desired pattern. Thumb wheel air flow control valves may be mounted on the handle portion to enable the rate of flow of atomizing air and the rate of flow of pattern air to be easily adjusted by the operator. In addition, a pattern air shut-off valve may advantageously be mounted on the handle portion to enable the flow of pattern air to be shut off to momentarily reduce the size of the spray pattern without changing the setting of the pattern air flow control valve.

A valve cartridge may be installed within a bore in the spray gun between the coating material flow control valve and the trigger. Preferably, the valve cartridge has a tapered front end portion which is installed within the tapered front end portion of the bore with an O-ring installed between the tapered front end portion of the valve cartridge and the tapered front end of the bore to make it easy to remove the valve cartridge from the spray gun for servicing or replacement.

BRIEF DESCRIPTION OF THE DRAWINGS

The foregoing and other features of the invention will become more apparent upon a consideration of the following description taken in connection with the accompanying drawings, wherein.

DESCRIPTION OF ONE SPECIFIC PREFERRED EMBODIMENT OF THE INVENTION

General Description

Figure 1:
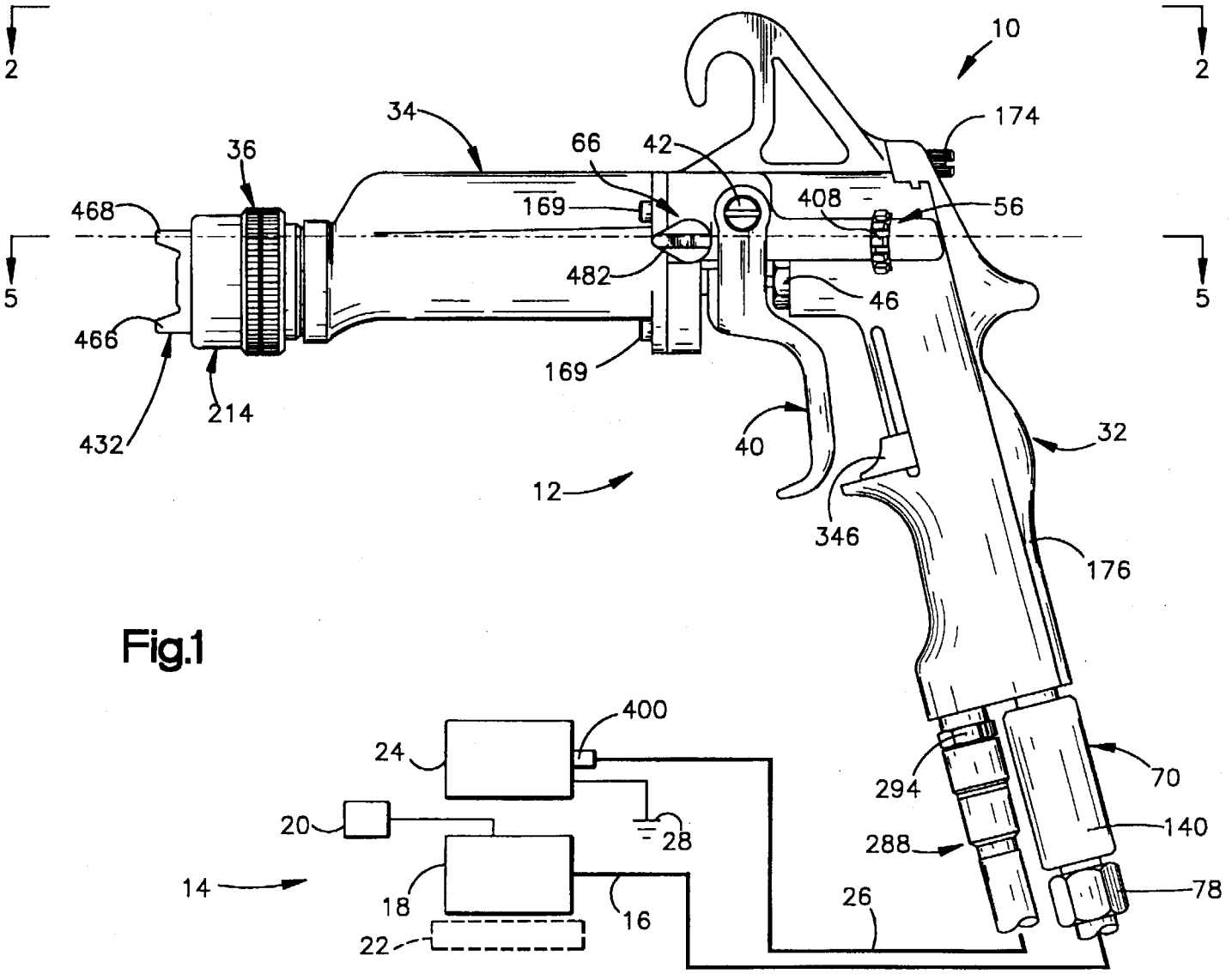
FIG. 1 illustrates a system which is constructed in accordance with the present invention and is used to apply electrostatically charged coating material to an object.

A system 10 for use in applying electrostatically charged coating material to an object (not shown) is illustrated in FIG. 1. The system 10 includes a spray gun 12 which is connected with a source 14 of electrically conductive and electrostatically charged liquid coating material by a coating material conduit 16. The source 14 of electrostatically charged liquid coating material includes a pump 18 which is connected to a high voltage power supply 20 to electrically charge the coating material in the pump. Such an arrangement is shown in U.S. Pat. No. 5,271,569 which is hereby incorporated by reference in its entirety. The pump 18 is electrically isolated from ground by a nonconductive housing which has been indicated schematically at 22 in FIG. 1. Such a nonconductive housing is shown in U.S. Pat. No. 5,271,569.

The spray gun 12 is light weight. In one embodiment of the invention, the spray gun 12 had a weight of less than 15 ounces. This light weight is due, in part at least, to the fact that the coating material is electrostatically charged at the source 14 rather than by electrical components in the spray gun 12. The light weight of the spray gun 12 is also promoted by forming the spray gun of light weight polymeric materials. Not only is the gun light weight but also, as will be described later on, only a paint line and air line are connected to the gun since there is no need to also connect an electrical high voltage or low voltage cable to the gun. This further reduces the effective weight of the gun when painting.

The electrostatic power supply 20 is operable to charge liquid coating material within the pump 18. The coating material is preferably a water-based liquid coating material which may be either clear or opaque when applied to an object. This type of coating material is electrically conductive. Since the coating material is electrically conductive, once it is charged at the pump, that charge will flow along the paint column in hose 16 and through the paint in gun 12 so that the paint is electrically charged when it is sprayed from the gun. For this reason the need for housing electrical charging components within the gun is eliminated, together with the need for connecting a high voltage cable or electric wire to the gun.

A source 24 of air to atomize the electrostatically charged liquid coating material and to control the spray pattern of atomized coating material from the spray gun 12, is connected to the spray gun through an air conduit 26. The air conduit 26 is connected to an electrical ground 28 in the manner later described in more detail.

Figure 2:
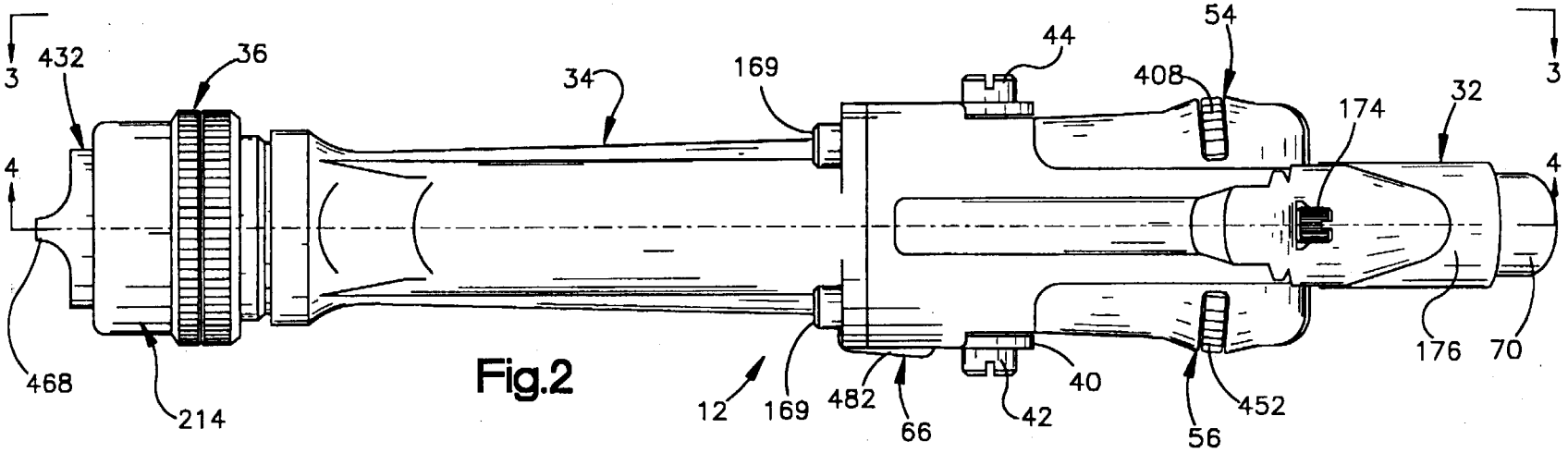
FIG. 2 is a top plan view, taken generally along the line 2—2 of FIG. 1, illustrating the construction of a spray gun used in the system of FIG. 1.
Figure 3:
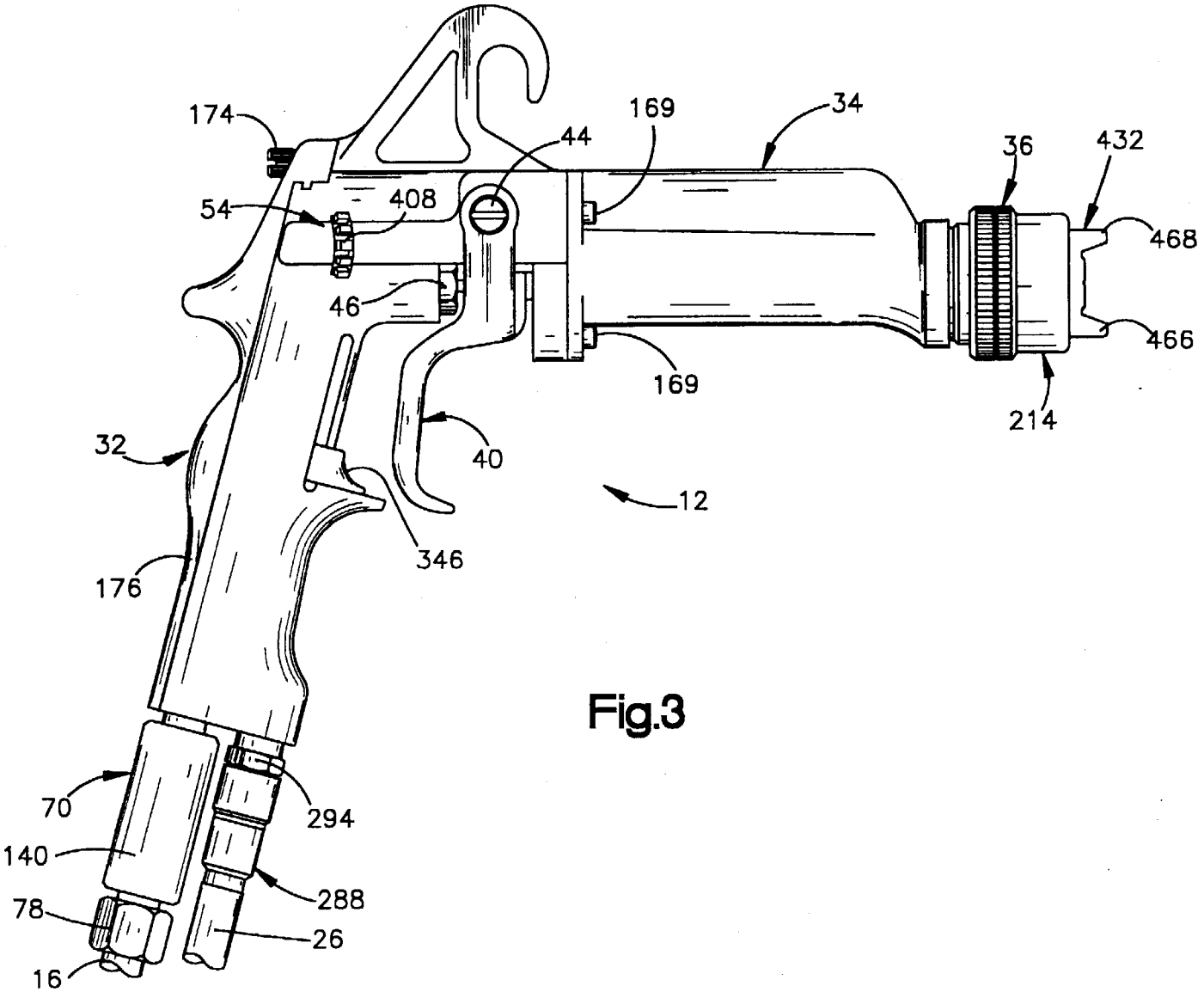
FIG. 3 is a side elevational view, taken generally along the line 3—3 of FIG. 2, further illustrating the construction of the spray gun.

The spray gun 12 includes an electrically conductive handle portion 32 (FIGS. 1, 2 and 3) which is grounded by the air conduit 26, as will be later described. An electrically nonconducting extension or barrel portion 34 is fixedly connected to and extends outward from the handle portion 32. A nozzle 36 is supported on an outer end of the extension portion 34. The nozzle 36 directs a spray of electrostatically charged liquid coating material toward an object. The nozzle 36 is effective to atomize the spray and to give the atomized spray a desired configuration or pattern in the manner disclosed in U.S. Pat. No. 4,544,100 issued Oct. 1, 1985 and entitled "Liquid Spray Gun Having Quick Change Pattern Control" which is hereby incorporated by reference in its entirety.

Figure 4:
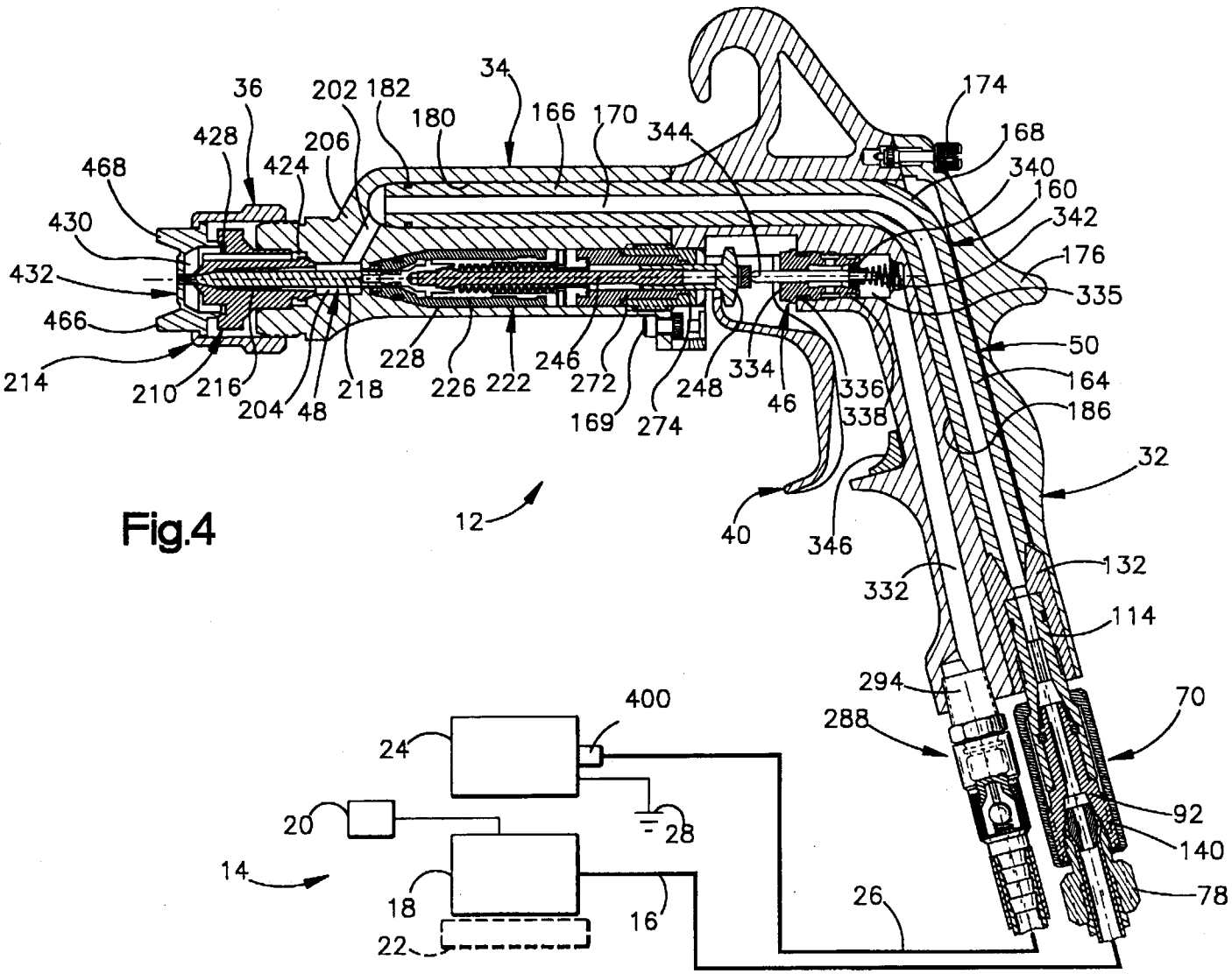
FIG. 4 is a sectional view, taken generally along the line 4—4 of FIG. 2, further illustrating the construction of the spray gun.

A trigger 40 is pivotally mounted on the handle portion 32 of the spray gun 12 by a pair of fasteners 42 and 44. The trigger 40 is pivotal relative to the handle portion 32. Pivotal movement of the trigger 44 controls actuation of a main air flow control valve 46 and a coating material flow control valve assembly 48 (FIG. 4). The trigger 40 is formed of the same electrically conductive material as the handle portion 32.

In accordance with one of the features of the present invention, a preformed fluid tube 50 (FIG. 4) conducts electrostatically charged liquid coating material from the conduit 16 through the electrically conductive handle portion 32 to the electrically insulating extension portion 34 of the spray gun 12. The preformed fluid tube 50 is formed of an electrically insulating material and electrically isolates the electrostatically charged liquid coating material from the electrically conductive handle portion 32 of the spray gun 12. The preformed fluid tube 50 is inflexible in that it maintains its preformed configuration when the tube is either inside or outside of the spray gun 12.

In accordance with another feature of the invention, a pair of air flow control valves 54 and 56 (FIG. 5) are provided in the electrically conductive handle portion 32 of the spray gun 12 to control the flow of atomizing air and pattern air to the nozzle 36. The air flow control valve 54 is disposed in an atomizing air passage 60 to control the flow of atomizing air to the nozzle 36. The air flow control valve 56 is disposed in a pattern air passage 62 to control a flow of pattern air to the nozzle 36.

A pattern air shut-off valve 66 is provided to block flow of pattern air through the pattern air passage 62 without changing the setting of the pattern air flow control valve 56. This enables the flow of pattern air to be quickly blocked or at least substantially reduced to establish a concentrated flow of atomized electrostatically charged liquid coating material from the nozzle 36 to an object. The pattern air shut-off valve 66 can subsequently be opened and a flow of pattern air is conducted through the nozzle 36 and pattern air flow control valve 56 at the same rate as before the pattern air shut-off valve was actuated.

Coating Material Conduit Connector Assembly

Figure 6:
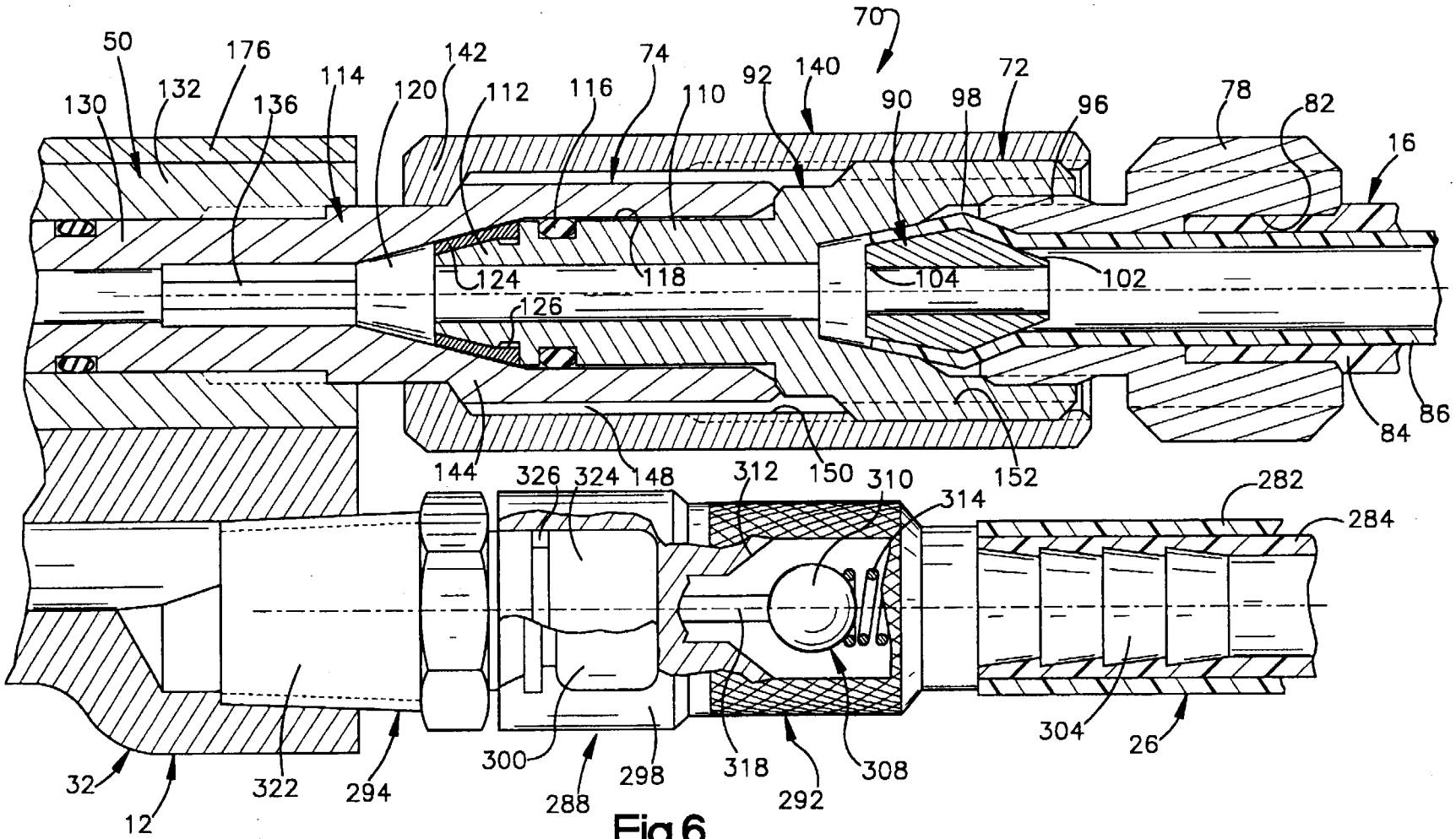
FIG. 6 is an enlarged fragmentary sectional view illustrating the manner in which a coating material conduit and an air conduit are connected with a handle portion of the spray gun of FIG. 1.

The electrostatically charged liquid coating material is conducted from the source 14 (FIG. 1) through the conduit 16 to a coating material conduit connector assembly 70 (FIG. 6). The connector assembly 70 connects the coating material conduit 16 with the handle portion 32 of the spray gun 12. The connector assembly 70 is formed of electrically nonconducting material. This enables the connector assembly 70 to electrically insulate the electrostatically charged liquid coating material from the electrically conductive and grounded handle portion 32 of the spray gun 12.

The coating material connector assembly 70 includes a plug assembly 72 (FIG. 6). The plug assembly 72 is connected to the coating material conduit 16. The coating material connector assembly 70 also includes a socket assembly 74 which is connected with the handle portion 32 of the spray gun 12. The plug assembly 72 is telescopically received in the socket assembly 74.

The plug assembly 72 includes an electrically insulating adaptor 78 which is connected with the coating material conduit 16. The coating material conduit 16 extends into an internally threaded cylindrical recess 82 (FIG. 6) formed in the adaptor 78. The internal threads in the recess 82 grip an outer layer 84 of the coating material conduit 16. The outer layer 84 of the coating material conduit 16 is formed of an electrically insulating material.

An inner layer 86 of the coating material conduit 16 extends axially through the adaptor 78 into space between an electrically insulating ferrule 90 and an electrically insulating plug 92. The inner layer 86 is also formed of an electrically insulating material. An axially outer end portion 96 of the adaptor 78 is externally threaded and engages internal threads formed in a recess 98 in the plug 92. The adaptor 78, ferrule 90, and plug 92 are formed of an electrically nonconductive material. In one specific embodiment of the invention, the adaptor 78, ferrule 90, and plug 92 were formed of polyether etherketone (PEEK). Of course, they could be formed of other electrically insulating materials if desired.

The ferrule 90 has a first conical end portion 102 which cooperates with the outer end portion 96 of the adaptor 78 to grip the inner layer 86 of the coating material conduit 16. In addition, the ferrule 90 has a conical end portion 104 which cooperates with a conical inner side surface of the recess 98 in the plug 92 to grip the inner layer 86 of the coating material conduit 16 between the ferrule and the plug.

The plug 92 (FIG. 6) has a cylindrical nose portion 110 with an axially tapered leading end portion 112. The nose portion 110 of the plug 92 is telescopically received in an electrically insulating socket 114 of the socket assembly 74. An O-ring seal 116 on the nose portion 110 of the plug 92 engages a cylindrical inner side surface 118 of a recess 120 in the socket 114. In addition, a conical seal cap 124 on the leading end portion 112 of the plug 92 is pressed against a conical inner side surface of the recess 120 in the socket 14.

The pressure exerted against the seal cap 124 by the conical inner side surface of the recess 120 in the socket 114 results in the material of the seal cap 124 cold flowing into an annular groove 126 in the leading end portion 112 of the plug 92 to interconnect the seal cap and the plug. In one specific embodiment of the invention, the seal cap 124 was formed of virgin unfilled synthetic fluorine-containing resin sold under the trademark "Teflon". Once the material of the seal cap 124 has been forced into the annular groove 126 by pressure between the plug 92 and socket 114, the seal cap engages the annular groove to retain the seal cap on the leading end portion 112 of the plug.

The electrically insulating socket 114 has a cylindrical end portion 130 with an external thread convolution which engages an internal thread convolution on an end portion 132 of the preformed fluid tube 50. The socket 114 has a hexagonal internal recess 136 which may be engaged by a suitable tool to rotate the socket 114 relative to the end portion 132 of the fluid tube 50 to securely interconnect the socket and the fluid tube. In one specific embodiment of the invention, the socket 114 was formed of polyether etherketone (PEEK).

In order to securely interconnect the plug 92 and the socket 114 and to provide additional electrical insulation for the interconnection between the plug and the socket, a cylindrical sleeve 140 (FIG. 6) encloses and interconnects the plug and the socket. The sleeve 140 has an annular flange 142 which engages a shoulder 144 on the socket 114. The sleeve 140 is freely rotatable relative to the shoulder 144 on the socket 114. The sleeve 140 has a cylindrical chamber 148 which receives the outer portion of the socket 114 and the plug 92.

Internal threads 150 on the inside of the chamber 148 engage external threads 152 on the plug 92. Rotation of the sleeve 140 about the central axis of the connector assembly 70 tightens the threaded connection between the sleeve and the plug 92 to press the plug into the recess 120 in the socket 114. The sleeve 140 is formed of an electrically nonconductive material to provide insulation for the interconnection between the plug 92 and socket 114. In one specific embodiment of the invention, the sleeve 140 was formed of acetal resin sold under the trademark "Delrin 500".

An important feature of this connector assembly 70 relates to operator safety. In some prior art guns the paint hose was connected to the barrel of the gun with the hose running up past the barrel with the operator's knuckles positioned next to the hose between the handle and the paint hose. Since the operator is grounded by the handle, it has been common for the operator to receive electrical shocks in his knuckles from the charged paint in the paint hose. By connecting the paint hose to the bottom of the handle the danger of shocking the operator's knuckles is avoided.

In addition, connector assembly 70 encloses the charged paint column being supplied to the bottom of the gun handle with nonconductive components which completely enclose the charged fluid column to further protect the operator from electric shock. Moreover, if any of the components of connector 70 become loose and paint or electric charge is permitted to leak from connector assembly 70, the electrical arcing which occurs will be either from connector 70 to the bottom of grounded handle 32, or from connector 70 to the grounded air hose connector 288 (later described). In either case the operator will not receive a shock because a grounded element is always present between the connector 70 and the operator's hand.

Spray Gun—Coating Material Flow Path

The electrostatically charged liquid coating material flows from the connector assembly 70 into the preformed fluid tube 50 (FIG. 4) in the spray gun 12. The preformed fluid tube 50 has an end portion 132 in which the socket 114 is telescopically received. The end portion 132 of the fluid tube 50 is friction welded to a body or main portion 160 of the fluid tube. Thus, the end portion 132 is rotated and pressed against an end of the fluid tube 50 to friction weld the end portion 132 to the main portion 160 of the fluid tube. The end portion 132 and main portion 160 of the fluid tube 50 are formed of an electrically nonconductive material, which in one embodiment of the invention was polypropylene.

The main portion 160 of the fluid tube 50 includes a first linear leg portion 164 (FIG. 4) which is connected with the end portion 132. The first leg portion 164 is disposed in the handle portion 32 of the spray gun 12. A second linear leg portion 166 of the main portion 160 of the fluid tube 50 extends from the handle portion 32 into the extension portion 34 of the spray gun 12. The first and second leg portions 164 and 166 of the main portion 160 of the fluid tube 50 are interconnected by an arcuate bend portion 168. Suitable fasteners 169 (FIGS. 1–3) releasably connect the electrically insulating extension portion 34 with the electrically conductive and grounded handle portion 32.

In order to facilitate assembly and disassembly of the spray gun 12, the fluid tube 50 (FIG. 4) is inflexible in that it maintains a configuration to which it is formed. Therefore, during handling of the fluid tube 50, the configuration of the arcuate bend portion 168 remains constant and the relationship between the leg portions 164 and 166 remains constant. This enables the fluid tube to be inserted into and removed from the spray gun 12 without changing the configuration of a passage 170 which extends between opposite end portions of the fluid tube 50. Therefore, the passage 170 does not become restricted due to crimping of the fluid tube 50 at the arcuate bend portion 168.

When the fluid tube 50 (FIG. 4) is to be inserted into the spray gun 12, a cover retaining screw 174 and an electrically conductive cover 176 are removed from the handle portion 32 of the spray gun. The second leg portion 166 of the fluid tube 50 is inserted into a cylindrical cavity 180 which extends from the handle portion 32 of the spray gun into the extension portion 34 of the spray gun. An O-ring seal 182 engages the inner side surface of the cavity 180 to seal a joint between the leg portion 166 and a portion of the cavity disposed in the extension portion 34. In addition, the leg portion 166 is coated with a dielectric grease to further block any electrical discharge from the electrostatically charged liquid coating material to the electrically grounded handle portion 32 along the joint between the leg portion and the electrically insulating extension portion 34 of the spray gun 12.

As the leg portion 166 is inserted into the cylindrical cavity 180, the leg portion 164 and bend portion 168 of the fluid tube 50 move into an outwardly opening groove or channel 186 (FIGS. 4 and 8) in the handle portion 32. The leg portion 164 (FIG. 4) and arcuate bend portion 168 are firmly pressed into the channel 186 to position the fluid tube 50 relative to the handle portion 32 of the spray gun 12. The cover 176 is then slid into place on the handle portion 32.

The cover 176 has a pair of parallel linear grooves 190 and 192 (FIG. 8) which extend lengthwise along opposite edge portions of the cover. The grooves 190 and 192 are engaged by linear guides or tracks 194 and 196 on the handle portion 32 to guide movement of the cover 176 into place on the handle portion and to retain the cover. Once the cover 176 has been slid into place on the handle portion 32, the cover retaining screw 174 (FIG. 4) is inserted through the cover and engages an internally threaded fitting in the handle portion to lock the cover in place. In one specific embodiment of the invention, the cover 176 and handle portion 32 were both formed of composite material polypropylene containing sufficient carbon fibers to be electrically conductive. Of course, other electrically conductive, even metallic, materials could be utilized if desired, but by using nonmetallic conductive composite materials the weight of the spray gun is reduced.

During operation of the spray gun 12, the electrostatically charged liquid coating material flows from the passage 170 (FIG. 4) in the fluid tube 50 to the nozzle 36 through a connector passage 202 and a chamber 204 in an outer end portion 206 of the extension portion 34. The extension portion 34 is formed of an electrically insulating material. In one specific embodiment of the invention, the extension portion 34 was formed of polypropylene.

The nozzle 36 includes an electrically nonconductive fluid tip 210 (FIG. 4) having external thread convolutions which engage internal threads on the end portion 206 of the extension portion 34 of the spray gun 12 to attach the fluid tip firmly to the end portion of the spray gun. An annular electrically nonconductive retaining collar 214 engages an air cap 432 (later described) which presses against the fluid tip 210. Collar 214 has internal threads which engage external threads on the outer end of the extension portion 34.

The fluid tip 210 (FIG. 4) has a cylindrical recess 216 into which a stainless steel needle valve 218 extends. The cylindrical recess 216 in the fluid tip 210 is connected in fluid communication with the chamber 204 in the extension portion 34. Therefore, electrostatically charged liquid coating material can flow through the fluid tip 210 when the needle valve 218 is in an open position.

The needle valve 218 is axially movable from the closed position shown in FIG. 4 through a range of open positions enabling electrostatically charged liquid coating material to flow through a central opening in the fluid tip 210 toward an object to be coated. When the needle valve 218 is in the closed position shown in FIG. 4, the needle valve blocks a flow of electrostatically charged liquid coating material through the central opening in the fluid tip 210.

Spray Gun—Cartridge Assembly

Force is transmitted between the needle valve 218 (FIG. 4) and the trigger 40 through a cartridge assembly 222 to effect movement of the needle valve between the closed position shown in FIG. 4 and a range of open positions. The cartridge assembly 222 biases the needle valve 218 toward the closed position shown in FIG. 4. The cartridge assembly 222 also provides a seal between the axially movable needle valve 218 and the stationary extension portion 34 of the spray gun 12.

The cartridge assembly 222 (FIG. 7) includes a generally cylindrical housing 226 which is received in a generally cylindrical chamber or bore 228 (FIG. 4) in the extension portion 34 of the spray gun 12. In accordance with one of the features of the present invention, the housing 226 has a conical front end portion 229 (FIG. 7) which extends outward from a cylindrical main portion 230 of the housing. An O-ring seal 232 is disposed in an annular groove 234 in the end portion 228 of the housing 226. The seal 232 abuttingly engages a conical inner side surface of the cartridge chamber 228, in the manner illustrated in FIG. 4. The seal 232 (FIG. 7) blocks fluid flow along the outside of the housing 226.

In accordance with another feature of the invention, an annular seal 238 (FIG. 7) is disposed in a cylindrical recess 240 in the end of the housing 226. The seal 238 is a spring biased U-cup, having resilient lips which are spring biased into engagement with the outer side surface of the needle valve 218 and the inner side surface of the recess 240. The seal 238 maintains a fluid tight seal between the needle valve 218 and the housing 226 during axial movement of the needle valve relative to the housing.

A layer of dielectric grease is provided between the outer surface of the housing 226 and the inner side surface of the cartridge chamber 228 (FIG. 4). The dielectric grease eliminates the possibility of an electrical discharge occurring between the charged spring 252 and the grounded handle 32 along the joint between the outer side surface of the housing 226 and the inner side surface of the cartridge chamber 228. Spring 252 is electrically charged due to the fact that it is metal and is in contact with the metal retainer 244 (later described) and metal needle valve 218 (later described) which is in contact with the charged paint flowing over needle valve 218.

The housing 226 (FIG. 7) is formed of material which is electrically nonconductive. In one specific embodiment of the invention, the housing 226 was formed of acetal resin sold under the trademark "Delrin". Of course, other electrically nonconducting materials could be used to form the housing 226 if desired.

The stainless steel needle valve 218 is connected with a stainless steel retainer 244 (FIG. 7) disposed in the housing 226. An actuator rod 246 has an end portion which is externally threaded and is connected with internal threads in the retainer 244. The actuator rod 246 is connected with a puller 248 (FIG. 4) which is engaged by the trigger 40. The actuator rod 246 and the puller 248 are formed of electrically nonconducting material. In one specific embodiment of the invention, the actuator rod 246 was formed of an acetal resin sold under the trademark "Delrin". In this specific embodiment of the invention, the puller 248 was formed of polyether etherketone (PEEK).

A biasing spring 252 (FIG. 7) is disposed in the housing 226 and engages the retainer 244. The metal biasing spring 252 urges the needle valve 218 toward the closed position. The biasing spring 252 is held in the housing 226 by engagement with an electrically insulating end cap 254. The end cap 254 has external threads which engage internal threads in the housing 226 to securely interconnect the end cap and the housing.

Figure 7:
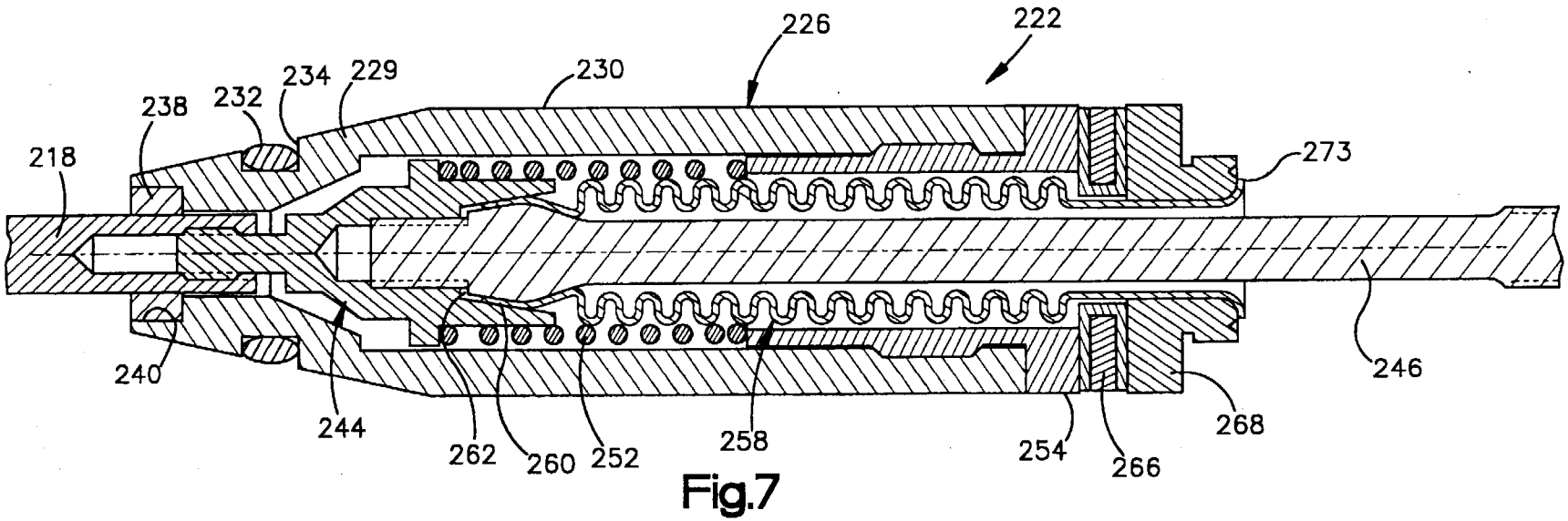
FIG. 7 is an enlarged sectional view illustrating the construction of a packing cartridge used in the spray gun of FIG. 1.

An electrically insulating bellows 258 extends around the actuator rod 246 (FIG. 7). An axially outer end portion 260 of the bellows 258 is firmly pressed against a frustoconical surface of a recess 262 in the retainer 244. A fluid tight seal is formed between the axially outer end portion 260 of the bellows and the retainer 244. The bellows 258 extends through an annular gasket 266 and an annular seal 268. A spacer 272 (FIG. 4) presses an axially inner end portion 273 (FIG. 7) of the bellows 258 firmly against the seal 268 to form a fluid tight seal with the inner end portion of the bellows.

A packing retainer 274 (FIG. 4) presses the spacer 272 against the seal. The packing retainer 274 has external threads which engage internal threads in the cartridge chamber 228. The gasket 266, seal 268, spacer 272 and retainer 274 are all formed of electrically insulating materials.

Upon actuation of the trigger 40 (FIG. 4) force is transmitted from the trigger to the puller 248. This force moves the puller 248 toward the right (as viewed in FIG. 4). The rightward movement of the puller 248 moves the actuator rod 246 toward the right (as viewed in FIGS. 4 and 7). As the actuator rod 246 is moved toward the right, the retainer 244 (FIG. 7) pulls the needle valve 218 toward the right to move the needle valve to an open position relative to the fluid tip 210 (FIG. 4) in the nozzle 36. As the needle valve 218 is moved toward the open position, a biasing spring 252 (FIG. 7) is compressed between the retainer 244 and the end cap 254 of the cartridge assembly 222.

When the trigger 40 is released, the force applied by the biasing spring 252 (FIG. 7) against the retainer 244 moves the needle valve 218 toward the left. The leftward movement of the needle valve 218 moves a conical outer end portion of the needle valve into fluid tight sealing engagement with a conical valve seat formed in the fluid tip 210 (FIG. 4).

The cartridge assembly 222 (FIG. 7) has a construction which is similar to the construction of known cartridge assemblies which are commercially available from Nordson Corporation of Amherst, Ohio 44001. However, the known cartridge assemblies which were previously commercially available from Nordson Corporation had an O-ring seal around a main portion 230 of the housing 226 (FIG. 7). These known cartridge assemblies did not have an O-ring seal 232 at the tapered end portion 229 of the housing 226. During installation and replacement of the known cartridge assemblies into and out of the cartridge chamber 228 in the spray gun 12, the O-ring seal around the cylindrical main portion 230 of the housing interfered with movement of the cartridge assembly.

The reason for this was that the O-ring was compressed between cartridge portion 230 and the chamber 228 so that when installing cartridge 222 into chamber 228, or withdrawing it from chamber 228, the compression force of the O-ring had to be overcome. By eliminating an O-ring between the cartridge portion 230 and chamber 228, and replacing it with an O-ring 232 installed on a tapering portion 229, however, the O-ring 232 provides no resistance against chamber 228 when being installed, and once retainer 274 is unthreaded, O-ring 232 tends to push the cartridge 222 back out chamber 228 to assist in its removal.

Another novel feature associated with cartridge assembly 222 is the effect of stainless steel needle valve 218, which is connected to cartridge 222, on the electrostatic field between the gun and the grounded part being painted. The paint is already electrically charged before being supplied to the gun as described above. Further, since the paint is already charged before being supplied to the gun, there is no charging electrode in the spray nozzle of the gun connected to an internal power supply or through a high voltage cable to an external power supply. Typically, this charging electrode has served not only to charge the paint but also to strengthen the electrostatic field between the spray gun and the part being coated which attracts the charged paint to the part. Needle valve 218, since it is electrically conductive, and electrically isolated from the handle by extension 34 and cartridge 222, is electrically "floating" (i.e., isolated) at the front end of the gun. It therefore becomes charged to the same electrical potential as the charged paint which is flowing over it. Once charged, the pointed front end of needle valve 218 strengthens the electrostatic field which is present between the front end of the gun and the grounded workpiece being painted. By strengthening the electrostatic field the charged paint is more strongly electrostatically attracted to the part. Thus, the needle valve 218 becomes a "field electrode" for the gun even though the gun has no charging electrode in the conventional sense. This is a very useful, novel feature of the present invention, since by strengthening the electrostatic field in this way, the efficiency of the electrostatic painting operation is increased.

Air Conduit

In accordance with another feature of the present invention, the air conduit 26 has an electrically insulating outer layer 282 (FIG. 6) which encloses an electrically conductive inner layer 284. By surrounding the electrically conductive inner layer 284 (FIG. 6) with the electrically insulating or nonconductive outer layer 282, the amount of insulation between the electrically grounded inner layer of the air conduit 26 and the closely adjacent coating material conduit 16 and coating material connector assembly 70 is increased. This tends to minimize any possibility of an electrical discharge occurring between the electrostatically charged liquid coating material in the conduit 16 and connector assembly 70 and the electrically grounded inner layer 284 of the air conduit 26.

It is contemplated that the electrically nonconductive outer layer 282 and the electrically conductive inner layer 284 of the air conduit 26 could be formed of many different materials. At the present time, it is contemplated that the outer layer 282 of the air conduit 26 will be formed of a urethane which is electrically nonconductive. It is contemplated that the inner layer 284 will be formed of a polyvinyl chloride (PVC) containing sufficient carbon black to make the inner layer 284 electrically conductive. The outer and inner layers 282 and 284 of the air conduit 26 are firmly interconnected to form a unitary assembly.

It is contemplated that the air conduit 26 may advantageously be used with many different types of spray guns. Thus, the air conduit 26 may advantageously be used to ground an electrically conductive handle portion of a spray gun which is supplied with coating material, which may be either a liquid or a powder, and is not electrostatically charged when conducted to the spray gun. The electrically conductive inner layer 284 of the air conduit 26 is believed to be a particularly advantageous way of grounding electrically conductive handle portions of many different types of spray guns which apply electrostatically charged coating materials to articles.

Air Conduit Connector Assembly

An air connector assembly 288 (FIG. 6) releasably interconnects the air conduit 26 and the handle portion 32 of the spray gun 12. The air connector assembly 288 is formed of an electrically conductive material. The air connector assembly 288 is effective to electrically interconnect the electrically conductive handle portion 32 of the spray gun 12 and the electrically grounded inner layer 284 of the air conduit 26. Therefore, the electrically conductive handle portion 32 of the spray gun 12 is electrically grounded through the air connector assembly 288 and the air conduit 26, as will be later described in more detail.

The air connector assembly 288 (FIG. 6) includes a socket assembly 292 and a plug assembly 294. The socket assembly 292 is connected to the air conduit 26. The plug assembly 294 is connected to the handle portion 32 of the spray gun 12. If desired, the plug assembly 294 could be connected to the air conduit 26 and the socket assembly 292 could be connected to the handle portion 32 of the spray gun 12.

The socket assembly includes a socket housing 298 in which the plug assembly 294 is telescopically received. A manually releasable latch slide 300 is slidably mounted on the socket housing 298. The slide 300 is manually movable between an engaged position interconnecting the plug assembly 294 and the socket housing 298 and a release position in which the slide 300 is ineffective to retain the plug assembly 294 in the socket housing 298.

The socket housing 298 has a barbed end portion 304 which is telescopically received in the electrically conductive inner layer 284 of the air conduit 26. The barbed end portion 304 deforms and resiliently expands the inner layer 284 of the air conduit 26. This results in a solid electrical interconnection between the barbed end portion 304 of the socket housing 298 and the electrically conductive inner layer 284 of the air conduit 26. Since the inner layer 284 of the air conduit 26 is electrically grounded, the socket housing 298 is electrically grounded by the inner layer 284 of the air conduit 26.

A shut-off valve assembly 308 is disposed within the socket housing 298 in the manner indicated schematically in FIG. 6. The shut-off valve assembly 308 includes a ball valve 310. The ball valve 310 is urged toward a conical valve seat 312 by a biasing spring 314.

When the socket assembly 292 is disconnected from the plug assembly 294, the biasing spring 314 presses the ball valve 310 against the valve seat 312 to block the flow of air from the conduit 26 through the socket assembly 292. The pressure of the air against the ball valve 310 further presses the ball valve against the valve seat 312. The resulting fluid tight seal between the ball valve 310 and socket housing 298 blocks leakage of air from the conduit 26 when the conduit is disconnected from the spray gun 12.

Upon insertion of the plug assembly 294 into the socket assembly 292, a valve actuator member, indicated schematically at 318 in FIG. 6, is engaged by a leading end portion of the plug assembly 294 and moves the ball valve 310 away from the valve seat 312 to the open position shown in FIG. 6. Once the ball valve 310 has been moved to the open position shown in FIG. 6, air can flow freely through the socket assembly 292 into the plug assembly 294.

The plug assembly 294 has a threaded end portion 322 which is connected with the handle portion 32 of the spray gun 12. The plug assembly 294 has a nose or outer end portion 324 which is received in the socket housing 298. An annular groove 326 in the plug assembly 294 is engaged by the slide 300 to retain the plug assembly 294 in the socket assembly 292. When the socket assembly 292 and plug assembly 294 are interconnected, the handle portion 32 is electrically connected with the grounded inner layer 284 of the air conduit 26 by the air connector assembly 288.

In one specific embodiment of the invention, the air connector assembly 288 was a quick disconnect coupling obtained from Colder Products Company, St. Paul, Minn. This particular embodiment of the air connector assembly 288 had a socket housing 298 and plug assembly 294 which were formed of brass which was chrome plated. Of course, other known coupling assemblies made of other materials which are electrically conductive could be used if desired.

An identical connector 329 to connector 288 may be used to connect the opposite end of air line 26 to a grounded metal header pipe (not shown) at pressurized air source 24. Thus, in this way the conductive handle 32 of the gun 12 is connected through the conductive inner layer 284 of line 26 to a grounded metal fitting or header pipe (not shown) in pressurized air source 24.

There is important advantage to the arrangement and structure of the air hose 26 and paint hose 16 described above. The air and paint hoses to electrostatic spray guns are commonly bound together to make the spray gun 12 easier to handle. If a prior art air hose having an external grounded conductive layer was used the charged paint inside the hose 16 would be more likely to electrically arc through hose 16 to the exterior grounded surface of the air hose. By placing the grounded conductive layer inside the air hose and putting an electrically insulated layer on the outside of the air hose, the possibility of this occurring with the hose arrangement of the present invention is greatly reduced. This improves the safety and reliability of the system.

Spray Gun—Main Air Flow

A main air flow passage 332 (FIG. 4) is formed in the handle portion 32. The main air flow passage 332 conducts air from the air connector assembly 288 to the main air flow control valve assembly 46. The main air flow control valve assembly 46 includes a metal body section 334 (FIG. 4) formed of aluminum and threaded into an opening to a cylindrical valve chamber 335 in the handle portion 32 of the spray gun 12. A pair of O-ring seals 336 and 338 extend around the housing 334 and seal joints between the housing and an inner side surface of the chamber 335.

A movable valve member 340 (FIG. 4) is pressed against an open axial end portion of the housing 334 to block flow of air from the main passage 332 into the housing 334. A biasing spring 342 presses the movable valve member 340 against the end portion of the housing 334. A valve actuator rod 344 is connected with the movable valve member 338. The actuator rod 344 engages the trigger 40.

Upon manual actuation of the trigger 40, the actuator rod 344 is moved toward the right (as viewed in FIG. 4) against the influence of the biasing spring 342 to move the valve member 340 to an open position. A slide 346 (FIGS. 1 and 3) is movable along the handle portion to limit the operating stroke of the trigger 40. When the valve member 340 is in the open position, air can flow from the main passage 332 into the housing 334. The air flows from the housing 334, through a plurality of circular openings in the housing, into an annular space which extends around the housing.

Figure 5:
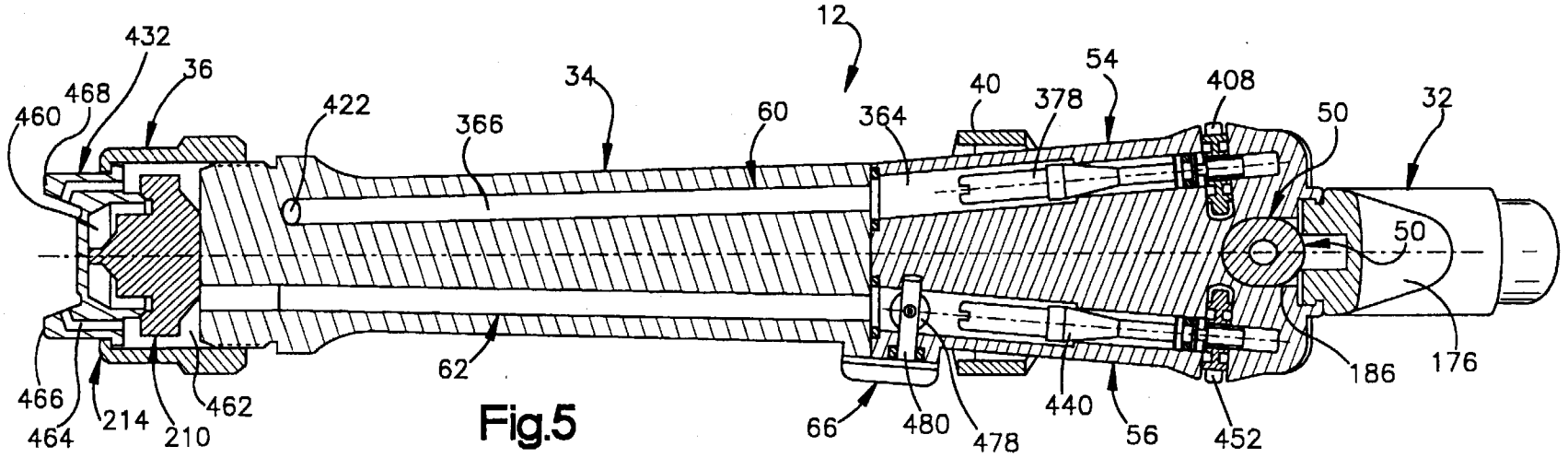
FIG. 5 is a sectional view, taken generally along the line 5—5 of FIG. 1, illustrating atomizing air and pattern air passages in the spray gun.
Figure 8:
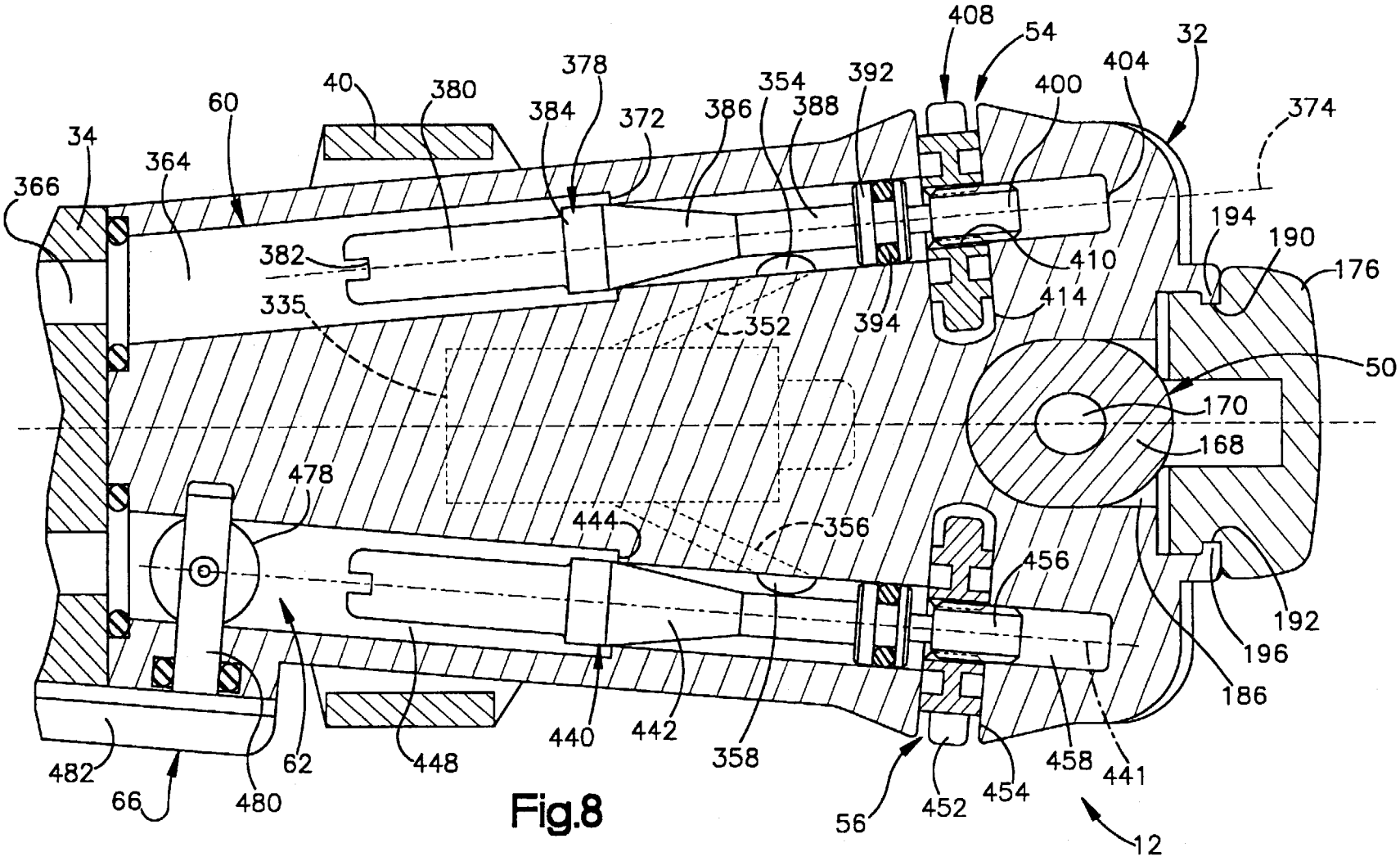
FIG. 8 is an enlarged fragmentary view of a portion of FIG. 5.

A portion of the air which flows into the annular space around the main air flow control valve housing 334 is conducted to the atomizing air passage 60 (FIG. 5). The remainder of the air which flows into the annular space around the main air flow control valve housing 334 (FIG. 4) is conducted to the pattern air passage 62 (FIG. 5). The annular space which extends around the valve housing 334 (FIG. 4) is disposed in the valve chamber 335 and is connected with the atomizing air passage 60 through a connector passage 352 (FIG. 8). The connector passage 352 has a generally circular outlet 354 to the atomizing air passage 60. Similarly, a connector passage 356 connects the annular space around the main air flow control valve assembly housing 334 (FIG. 4) with the pattern air passage 62. The connector passage 356 (FIG. 8) has a generally circular outlet 358 to the pattern air passage 62.

Spray Gun—Atomizing Air Flow

Air is conducted from the main air flow control valve assembly 46 (FIG. 4) to the atomizing air passage 60 (FIG. 8) through the connector passage 352. The atomizing air passage 60 includes a first section 364 which is disposed in the handle portion 32 and a second section 366 (FIG. 5) which extends through the extension portion 34. The atomizing air flow control valve assembly 54 is operable to control the rate of flow of atomizing air from the main air flow control valve assembly 46 through the first and second sections 364 and 366 of the atomizing air passage 60 to the nozzle 36.

The atomizing air flow control valve assembly 54 (FIG. 8) includes an annular valve seat 372 disposed in the first section 364 of the atomizing air passage 60. The valve seat 372 has a central axis which is coincident with a longitudinal central axis 374 of the first section 364 of the atomizing air passage 60. An atomizing air needle valve 378 is disposed in the first section 364 of the atomizing air passage 60. The atomizing air needle valve 378 has a longitudinal central axis which is coincident with the longitudinal central axis 374 of the first section 364 of the atomizing air passage 60.

The atomizing air needle valve 378 is integrally formed as one piece of electrically insulating material. In one specific embodiment of the invention, the atomizing air needle valve 378 was formed of glass filled acetal resin sold under the trademark "Delrin". Of course, the atomizing air needle valve could be formed of other materials if desired.

The atomizing air needle valve 378 has a cylindrical stem portion 380 with a slot 382. The slot 382 is engageable by a screwdriver or similar tool to install the atomizing air needle valve 378 in the first section 364 of the atomizing air passage 60.

A relatively large diameter cylindrical connector portion 384 of the atomizing air needle valve 378 is disposed in a coaxial relationship with the stem portion 380 and with the longitudinal central axis 374 of the first section 364 of the atomizing air passage 60. A conical seal portion 386 tapers axially from the connector portion 384 to a cylindrical rod portion 388 of the atomizing air needle valve 378. The conical seal portion 386 has a central axis which is coincident with the longitudinal central axis 374 of the first section 364 of the atomizing air passage 60. The conical seal portion 386 is disposed in a coaxial relationship with the rod portion 388 cod the connector portion 384 of the atomizing air needle valve 378.

The atomizing air needle valve 378 is movable axially from a closed position through a range of open positions. When the atomizing air needle valve 378 is in the closed position of FIG. 8, the conical seal portion 386 engages the valve seat 372 to block a flow of atomizing air. When the atomizing air needle valve 378 is in an open position, the conical seal portion 386 is spaced to the left (as viewed in FIG. 8) of the valve seat 372. This enables atomizing air to flow from the connector passage outlet 354 along the first section 364 of the atomizing air passage 60. The further the conical seal portion 386 is spaced from the valve seat 372, the greater the rate of flow of atomizing air.

A cylindrical piston 392 is connected with the end of the rod portion 388 opposite from the conical seal portion 386. The piston 392 is disposed in a coaxial relationship with the rod portion 388 and the conical seal portion 386. The piston 392 has an annular groove in which an O-ring seal 394 is disposed. The O-ring seal 394 is disposed in tight sealing engagement with and is slidable along a cylindrical inner side surface of the first section 364 of the atomizing air passage 60.

The outlet 354 from the connector passage 352 is disposed between the piston 392 and the conical seal portion 386 of the atomizing air needle valve 378. Therefore, air pressure is applied against the left (as viewed in FIG. 8) end of the piston 392. The air pressure against the left end of the piston 392 urges the atomizing air needle valve toward the right and its closed position.

An externally threaded end portion 400 extends axially outward from the piston 392. The threaded end portion 400 has a central axis which is coincident with the central axis of the piston 392 and the longitudinal central axis 374 of the first section 364 of the atomizing air passage 60. Unlike the rod portion 388, the threaded end portion 400 of the atomizing air valve 378 has a generally D-shaped cross sectional configuration.

Thus, a flat is formed along one longitudinally extending side of the threaded end portion 400. The flat extends parallel to the longitudinal central axis of the threaded end portion 400. An arcuate outer side surface extends between opposite edges of the flat on the threaded end portion 400. This arcuate outer surface has a center of curvature which is disposed on the longitudinal central axis of the atomizing air valve 378.

The threaded end portion 400 (FIG. 8) of the atomizing air valve is received in an unthreaded end portion 404 of the atomizing air passage 60. The unthreaded end portion 404 of the atomizing air passage 60 has a D-shaped cross sectional configuration. A longitudinal central axis of the unthreaded end portion 404 is coincident with the longitudinal central axis of the threaded portion 400 of the atomizing air valve 378 and the central axis 374 of the first section 364 of the atomizing air passage.

Although the threaded end portion 400 of the atomizing air valve 378 and the unthreaded end portion 404 of the atomizing air passage 60 have the same D-shaped cross sectional configuration, the unthreaded end portion 404 of the atomizing air passage 60 has a slightly larger cross sectional size than the threaded portion 400 of the atomizing air valve 378. This allows the threaded end portion 400 of the atomizing air valve 378 to slide freely along the unthreaded end portion 404 of the atomizing air passage 60. During sliding movement of the threaded portion 400 of the atomizing air valve 378 along the unthreaded end portion 404 of the atomizing air passage 60, the flat side surface on the threaded portion of the atomizing air valve cooperates with a flat on the unthreaded end portion 404 of the atomizing air passage 60 to hold the atomizing air valve 378 against rotation about its longitudinal central axis.

A circular thumb wheel 408 (FIG. 8) has a central opening 410 with internal threads. The threaded opening 410 in the thumb wheel 408 engages external threads on the threaded end portion 400 of the atomizing air valve 378. The thumb wheel 408 is disposed in a slot 414 formed in the handle portion 32 of the spray gun 12. The thumb wheel 408 is formed of glass filled acetal resin sold under the trademark "Delrin". Of course, the thumb wheel 408 could be formed of other materials if desired.

The thumb wheel 408 is rotatable about the coincident longitudinal central axes of the atomizing air valve 378 and first section 364 of the atomizing air passage 60. The slot 414 in the handle portion 32 holds the thumb wheel against axial movement. Therefore, rotation of the thumb wheel 408 results in axial movement of the atomizing air valve 378 relative to the valve seat 372. This enables the position of the atomizing air valve to be adjusted axially along the atomizing air passage 60 to provide a desired air flow rate between the valve seat 372 and the seal portion 386 of the atomizing air valve.

If an operator should inadvertently rotate the thumb wheel 408 to such an extent that the external thread on the threaded end portion 400 of the atomizing air valve becomes disengaged from the internal thread on the thumb wheel 408, the fluid pressure applied against the piston 392 will press the threaded end portion 400 up against the central portion of the thumb wheel 408. This allows the internal thread in the central opening 410 in the thumb wheel 408 to re-engage the external thread on the end portion 400 of the atomizing air valve. Since the thumb wheel 408 is disposed in the slot 414, the handle portion 32 protects the thumb wheel against impacts with adjacent objects during use of the spray gun 12 by an operator.

The atomizing air flow control valve assembly 54 is connected in fluid communication with the nozzle 36 (FIG. 5) through the second section 366 of the atomizing air passage 60. The second section 366 of the atomizing air passage 60 has an inlet which is aligned with the outlet to the first section 364 of the atomizing air passage 60. Therefore, atomizing air can flow through the atomizing air flow control valve assembly 54 and through the atomizing air passage 60 to a connector passage 422 (FIG. 5).

The connector passage 422 is connected with an annular manifold chamber 424 (FIG. 4) which extends around the inner end of the fluid tip 210 of the nozzle 36. A plurality of passages 428 extend axially through the fluid tip 210 and connect the annular manifold chamber 424 with an internal chamber 430. The internal chamber 430 is formed between the outer end portion of the fluid tip 210 and an inner side surface of a circular air cap 432. The annular retaining ring 214 presses the air cap 432 against the fluid tip 210 to form a fluid tight seal between the air cap 432 and fluid tip 210. The fluid tip 210, retaining ring 214, and air cap 432 are formed of an electrically insulating material.

Atomizing air is conducted through a circular opening at the center of the air cap 432 along with the electrostatically charged liquid coating material. In addition, atomizing air is conducted through a plurality of passages disposed in a circular array about the central opening in the air cap 432. The flow of air through the various passages in the air cap 432 is effective to atomize the flow of electrostatically charged liquid coating material conducted through the fluid tip 210. The manner in which the electrostatically charged liquid coating material is atomized by this flow of air is the same as is disclosed in the aforementioned U.S. Pat. No. 4,544,100 issued Oct. 1, 1985 and entitled "Liquid Spray Gun Having Quick Change Pattern Control".

It is contemplated that the atomizing air flow control valve arrangement illustrated in FIGS. 5 and 8 may be used with many different types of spray guns which are used to spray many different types of electrostatically charged coating materials.

Spray Gun—Pattern Air Flow

The connector passage 356 (FIG. 8) extends from the main air flow control valve 46 (FIG. 4) to the outlet 358 (FIG. 8) in the pattern air passage 62. The pattern air flow control valve assembly 56 controls the rate of flow of air from the connector passage 356 along the pattern air passage 62 to the nozzle 36 (FIG. 5). The pattern air flow control valve assembly 56 controls pattern air flow in the same manner as in which the atomizing air flow control valve assembly 54 controls the flow of atomizing air.

The pattern air flow control valve assembly 56 includes a pattern air needle valve 440 (FIG. 8). The pattern air needle valve 440 has a longitudinal central axis which is coincident with a longitudinal central axis 441 of a first section 448 of the pattern air passage 62. The pattern air needle valve 440 has a conical seal section 442 which is engageable with an annular valve seat 444. Axial movement of the pattern air needle valve 440 along the axis 441 controls the flow of pattern air through the pattern air passage 62 in the same manner as in which the conical seal portion 386 of the atomizing air valve 378 cooperates with the valve seat 372 to control the flow of atomizing air through the atomizing air passage 60.

A thumb wheel 452 (FIG. 8) is disposed in a slot 454 in the handle portion 32. The thumb wheel 452 has an internally threaded central portion which engages an externally threaded end portion 456 of the pattern air valve 440. The externally threaded end portion 456 of the pattern air needle valve 440 has a D-shaped cross sectional configuration. The externally threaded end portion 456 of the pattern air needle valve 440 extends into an unthreaded end portion 458 of the first section 448 of the pattern air passage. The unthreaded end portion 458 of the pattern air passage 62 has a D-shaped cross sectional configuration and holds the pattern air needle valve 440 against rotation about its central axis.

Rotation of the thumb wheel 452 about the coincident central axes of the first portion 448 of the pattern air passage 62 and the pattern air needle valve 440 results in the pattern air needle valve being moved axially along the pattern air passage. As the pattern air needle valve 440 is moved axially along the pattern air passage 62, the conical seal portion 442 cooperates with the valve seat 444 to vary the rate of pattern air flow through the pattern air passage 62. Since the thumb wheel 452 is disposed in the slot 454, the handle portion 32 protects the thumb wheel against impacts with adjacent objects during use of the spray gun 12.

The pattern air passage 62 conducts a flow of pattern air from the pattern air flow control valve assembly 56 to an annular chamber 462 (FIG. 5) in the nozzle 36. Air is conducted from the annular chamber 462 through passages 464 (FIG. 5) in a pair of air horns 466 and 468 on the air cap 432. The flow of air from the horns 466 and 468 imparts a fan-shaped configuration to the flow of atomized electrostatically charged liquid coating material in a known manner. The flow of air from the annular chamber 462 through the air horns 466 and 468 is the same as is disclosed in the aforementioned U.S. Pat. No. 4,544,100 issued Oct. 1, 1985 and entitled "Liquid Spray Gun Having Quick Change Pattern Control".

The collar 214 of the nozzle 36 can be rotated relative to the externally threaded outer end of the extension portion 34. This releases the air cap 432 so that it can be rotated relative to the fluid tip 210. Rotation of the air cap 432 relative to the fluid tip 210 enables the orientation of the air horns 466 and 468 to be changed. In FIG. 5, the orientation of the air horns 466 and 468 has been changed by 90° from the orientation of FIGS. 1–4 in order to illustrate the passages 464 in the air horns.

In accordance with another feature of the invention, a pattern air shut-off valve assembly 66 (FIGS. 5 and 8) is provided in series with the pattern air flow control valve assembly 56. The pattern air shut-off valve assembly 66 is disposed in the electrically conductive handle portion 32. Therefore, the pattern air shut-off valve assembly is grounded through the air conduit 26 along with the handle portion 32 of the spray gun 12.

The pattern air shut-off valve assembly 66 can be quickly operated between open and closed positions. It is contemplated that during normal use of the spray gun 12, the pattern air shut-off valve assembly 66 will be in the open condition in which the pattern air shut-off valve does not interfere with the flow of pattern air through the pattern air passage 62. However, when it is desired to have a concentrated or narrower pattern of electrically charged liquid coating material from the spray gun 12, the pattern air shut-off valve 66 is closed. This interrupts the flow of pattern air from the air horns 466 and 468 (FIG. 5) on the nozzle 36.

The pattern air flow control valve assembly 66 includes a circular stainless steel butterfly valve 478. The butterfly valve 478 is disposed in the pattern air passage 62 and has the same diameter as the pattern passage. The circular butterfly valve 478 is rotatably supported by an axle shaft 480. A manually actuatable knob 482 is integrally formed as one piece with the axle shaft 480.

The butterfly valve 478 is mounted in a slot formed along a central axis of the axle shaft 480. The central axis of the axle shaft 480 is coincident with a diametral axis of the butterfly valve 478.

When the pattern air shut-off valve assembly 66 is to be operated from the open condition of FIG. 8 to the closed condition, the knob 482 is rotated through 90° to rotate the circular butterfly valve 478 through 90° about the longitudinal central axis of the axle shaft 480. The butterfly valve 478 has the same diameter as the cylindrical first section 448 of the pattern air passage 62. Therefore, when the butterfly valve 478 is rotated through 90° from the position shown in FIG. 8, the butterfly valve extends across the pattern air passage 62 and blocks the flow of pattern air through the passage.

When the shut-off valve assembly 66 is in the closed condition, the butterfly valve 478 blocks air flow through the pattern air passage 62. However, it is contemplated that instead of completely blocking the air flow there may instead be a restricted flow of pattern air around the butterfly valve 478 when the shut-off valve assembly 66 is in the closed condition. This restricted flow of pattern air is insufficient, however, to significantly alter the conical pattern of the spray of electrostatically charged liquid coating material from the nozzle 36.

It is contemplated that the pattern air control arrangement illustrated in FIGS. 5 and 8 may be used with many different types of spray guns which are used to spray many different types of electrostatically charged coating materials.

To further elaborate on this feature involving the pattern air shut-off valve assembly 66, if the valve is closed and horn air from air horns 466, 468 is not present, the spray pattern produced is a conical spray pattern approximately 6 inches in diameter, 12 inches from the gun. Once the horn air is turned on by the opening of valve 66, that conical pattern is flattened to produce a wider fan shaped pattern. Sometimes, it would be beneficial if the pattern could quickly be changed from the wide flat spray pattern to the narrower conical spray pattern such as when painting edges of recesses of an article. That is made possible by the present invention wherein the pattern shut-off valve 66 is placed in series with the infinitely adjustable pattern air control valve 56. The operator can use valve 56 to set the optimal fan width for the article being coated and then, without disturbing the setting of valve 56, the operator can quickly turn valve 66 to shut off the pattern air to paint momentarily with a narrower spray pattern and then quickly open it back up to paint with the preset wide fan pattern. In addition, both valves are placed in the rear, grounded handle portion of the gun so that the operator does not have to put his hand up near the charged end of the gun, where his hand could be shocked or painted, to operate either valve.

Conclusion

The present invention provides a new and improved system 10 (FIG. 1) for use in applying electrostatically charged electrically conductive coating material to an object. The system 10 includes a light weight spray gun 12 which paints efficiently electrostatically while protecting the operator from electric shock. An inflexible fluid tube 50, that is, a fluid tube which retains a preformed shape, is provided in the handle portion 32. The fluid tube 50 conducts a flow of electrostatically charged coating material through the handle portion 32 while maintaining the coating material electrically insulated from the handle portion to protect the operator from electric shock. The handle portion 32 is advantageously connected with an electrical ground 28 through an inner layer 284 of electrically conductive material inside an air conduit 26. The electrostatic efficiency of the coating system may be increased by providing a floating field electrode in the nozzle of the spray gun.

The spray gun 12 has an air passage 60 to conduct a flow of air to atomize the flow of coating material and a second passage 62 to conduct air to shape the flow of atomized coating material to a desired configuration or pattern. Thumb wheel operated, air flow control valves 54 and 56 are mounted on the handle portion 32 to enable the rate of flow of atomizing air and the rate of flow of pattern air to be easily adjusted by the operator. In addition, a pattern air shut-off valve 66 is advantageously mounted on the handle portion 32 to enable the flow of pattern air to be shut off to momentarily increase the size of the spray pattern without changing the setting of the pattern air flow control valve 56.

A valve cartridge 222 is provided which is easily installed and easily replaced. The valve cartridge 222 may be installed within a bore 228 in the spray gun 12 between a coating material flow control valve 218 and the trigger 40. Preferably, the valve cartridge 222 has a tapered front end portion 229 which is installed with the tapered front end portion of the bore 228 with an O-ring 232 installed between the tapered front end portion of the valve cartridge and the tapered front end of the bore to make it easy to remove from the spray gun 12 for servicing or replacement.

Other novel features and benefits of the invention have been described above in connection with the preferred embodiment of the invention, and many variations within the teachings of the invention will be obvious to those skilled in the art. The invention is therefore intended to be limited only by the scope of the appended claims.

Having described the invention, the following is claimed:

1. An apparatus for use in applying electrostatically charged coating material to an object, said apparatus comprising a spray gun having a handle portion which is electrically grounded, an extension portion connected to and extending outward from said handle portion, said extension portion being formed of a material which is electrically nonconductive, a nozzle connected with said extension portion to direct a flow of electrostatically charged coating material toward the object, a preformed fluid tube having first and second end portions interconnected by an arcuate bend portion, said tube being preformed to a desired configuration from a material which is electrically nonconductive and which maintains the configuration to which it is preformed, said tube being removably installed in said spray gun, and a coating material conduit connector connected to said first end portion of said tube to connect a coating material conduit with said tube to enable coating material to be conducted from the coating material conduit to said tube through the coating material conduit and said coating material conduit connector.

2. An apparatus as set forth in claim 1 wherein said coating material conduit supplies electrically charged coating material to said tube.

3. An apparatus as set forth in claim 1 wherein said first end portion and said arcuate bend portion of said tube being disposed in said electrically conductive handle portion, said second end portion of said tube extending from said electrically conductive handle portion into said extension portion.

4. An apparatus as set forth in claim 1 wherein said coating material conduit connector being formed of a material which is electrically nonconductive to enable electrostatically charged coating material to be conducted from the coating material conduit through said coating material conduit connector and said tube to said extension portion with the electrostatically charged coating material electrically insulated from said electrically conductive handle portion.

5. An apparatus for use in applying electrostatically charged coating material to an object, said apparatus comprising a spray gun having a handle portion which is electrically conductive, an extension portion connected to and extending outward from said electrically conductive handle portion, said extension portion being formed of a material which is electrically nonconductive, and a nozzle connected with an end portion of said extension portion to direct a flow of electrostatically charged coating material toward the object, and further comprising a coating material conduit through which coating material is conducted to said spray gun, and an air conduit through which air is conducted to said spray gun, said air conduit including an electrically conductive path disposed inside said air conduit and connected with an electrical ground.

6. An apparatus as set forth in claim 5 including a nonconductive coating connector assembly interconnecting said coating material conduit and said electrically conductive handle portion of said spray gun and through which coating material is conducted into said electrically conductive handle portion of said spray gun.

7. An apparatus as set forth in claim 5 wherein said electrically conductive path inside said air conduit is formed by an inner layer of electrically conductive material, said air conduit includes an outer layer formed of an electrically nonconductive material which extends around said inner layer to electrically insulate said inner layer.

8. An apparatus as set forth in claim 7, further including a first air connector assembly interconnecting said air conduit and said electrically conductive handle portion of said spray gun and through which air is conducted into said electrically conductive handle portion of said spray gun, said first air connector assembly including a portion which is formed of a material which is electrically conductive and is connected with said inner layer of said air conduit and said electrically conductive handle portion to electrically ground said electrically conductive handle portion through said first air connector assembly and said inner layer of said air conduit.

9. An apparatus as set forth in claim 8 wherein said first air connector assembly includes a valve which is operable between an open condition and a closed condition, said valve being effective to block flow of air from said air conduit when said valve is in the closed condition, said valve being ineffective to block flow of air from said air conduit when said valve is in the open condition, said first air connector assembly including means for effecting operation of said valve from the open condition to the closed condition upon disconnection of said air conduit from said electrically conductive handle portion, said first air connector assembly including means for effecting operation of said valve from the closed condition to the open condition upon connection of said air conduit with said electrically conductive handle portion.

10. An apparatus as set forth in claim 8 wherein a second air connector assembly is connected to the opposite end of said air conduit and to a source of pressurized air, said source having an electrically grounded portion, said second air connector assembly including electrically conductive components which electrically ground said inner layer to said electrically grounded portion of said source.

11. An apparatus as set forth in claim 6 wherein said coating material conduit supplies electrically charged paint to said spray gun.

12. An electrostatic coating system comprising an electrostatic spray gun having a coating material passage within the gun and a coating material conduit connected to a source of coating material and to said coating material passage, an electrical power supply connected to said source to charge said coating material in said source, said charged coating material being supplied from said source through said conduit to said passage and being sprayed through a spray nozzle mounted to said spray gun at the end of said passage, a conductive member being supported within said spray nozzle, said conductive member being electrically isolated from ground and being charged by said charged coating material.

13. The electrostatic coating system of claim 12 wherein said conductive member is a valve shaft which controls the flow of charged coating material through said nozzle, said valve shaft having a tapered end.

14. The electrostatic coating system of claim 13 wherein said spray gun has an electrically grounded handle and said conduit is connected to said handle to supply said charged coating material through said handle to said passage.

15. A spray gun having a coating material passage within the gun, a spray nozzle mounted to the gun at the end of said passage, and a flow control valve located within said passage, said flow control valve having a valve shaft, a cartridge assembly being connected to said valve shaft at one end and to a valve actuator at the other end, said cartridge assembly being received within a bore within the gun, the bore having a forward tapered portion, said cartridge assembly having a forward tapered portion corresponding to said forward tapered portion of said bore, said forward tapered portion of said cartridge assembly being received within said forward tapered portion of said bore, an O-ring encircling said forward tapered portion of said cartridge assembly, a retainer element securing said cartridge assembly within said bore and compressing said O-ring between said forward tapered portion of said cartridge assembly and said forward tapered portion of said bore.

16. The spray gun of claim 15 wherein said spray gun is a manual spray gun and said actuator is a trigger.

17. Art electrostatic coating system, comprising an electrostatic spray gun having a handle, a coating material conduit connected with said spray gun handle, said coating material conduit conducts a flow of electrically charged coating material to said spray gun, and wherein an air conduit is connected with said handle of said spray gun, said air conduit conducts a flow of air to said spray gun, said air conduit being connected to an electrical ground at one end and with said handle at the other end, said air conduit including an electrically conductive element enclosed within said air conduit and extending between said ends of said air conduit to electrically connect said 1 handle with said electrical ground through said electrically conductive element disposed in said air conduit.

18. The electrostatic coating system of claim 17 further including an electrically conductive fitting which connects said air conduit and said electrically conductive element with said handle.

19. The electrostatic coating system of claim 17 wherein said air conduit includes a tubular outer layer formed of an electrically nonconductive material, said electrically conductive element being a tubular inner layer formed of an electrically conductive material connected with said tubular outer layer, said tubular outer and inner layers being effective to conduct a flow of air to said spray gun during operation of said spray gun.

20. The electrostatic coating system of claim 17 further including an electrically nonconductive fitting which connects said coating material conduit with said handle.

21. An apparatus for use in applying electrostatically charged coating material to an object, said apparatus comprising a spray gun having a handle portion which is electrically conductive, and a nozzle connected with said handle portion to direct a flow of electrostatically charged coating material toward the object, a coating material conduit through which coating material is conducted to said spray gun, an air conduit having a passage through which air is conducted to said spray gun, said air conduit including a conductor element formed of an electrically conductive material and connected with an electrical ground, said air conduit further includes an outer layer formed of an electrically nonconductive material and extending around said conductor element to electrically insulate said conductor element, said passage in said air conduit through which air is conducted to said spray gun and said conductor element being at least partially enclosed by said outer layer of said air conduit, an air conduit connector assembly interconnects said air conduit and said spray gun, said air conduit connector assembly includes a portion which is formed of a material which is electrically conductive, said portion of said air conduit connector assembly which is electrically conductive being connected with said conductor element of said air conduit and with said electrically conductive handle portion to electrically ground said electrically conductive handle portion through said air conduit connector assembly and said conductor element of said air conduit.

22. An apparatus as set forth in claim 21 wherein said air conduit connector assembly includes a valve which is operable between an open condition and a closed condition, said valve being effective to block flow of air from said air conduit when said valve is in the closed condition, said valve being ineffective to block flow of air from said air conduit when said valve is in the open condition, said air conduit connector assembly including means for effecting operation of said valve from the open condition to the closed condition upon disconnection of said air conduit from said spray gun, said air conduit connector assembly including means for effecting operation of said valve from the closed condition to the open condition upon connection of said air conduit with said spray gun.

23. An apparatus as set forth in claim 21 further including a coating material conduit connector assembly interconnecting said coating material conduit and said spray gun, said coating material conduit connector assembly includes a first component which is connected with said electrically conductive handle portion and a second component which is connected with said coating material conduit, said first and second components being formed of an electrically nonconductive material, one of said first and second components being telescopically received in the other of said first and second components when said coating material conduit is connected with said electrically conductive handle portion, said coating material conduit connector assembly including a rotatable sleeve which at least partially encloses said first and second components when said first and second components are telescopically interconnected.

24. An apparatus as set forth in claim 21 wherein said spray gun includes an extension portion which is connected to and extends outward from said electrically conductive handle portion, said extension portion being formed of a material which is electrically nonconductive, and a preformed fluid tube which extends into said extension portion, said fluid tube being formed of an electrically nonconductive material to electrically insulate coating material conducted through said fluid tube from said electrically conductive handle portion, said fluid tube having a first end portion which is connected with said coating material conduit and a second end portion which is disposed in said extension portion, said fluid tube being formed of a material which maintains a configuration to which it is preformed.

25. An apparatus as set forth in claim 21 wherein said nozzle includes a first plurality of openings through which air is conducted to atomize a flow of coating material from said nozzle and a second plurality of openings through which air is conducted to control the configuration of a flow of atomized coating material from said nozzle, said apparatus further including a first air passage extending from said handle portion to conduct a first flow of air which is directed through said first plurality of openings in said nozzle to atomize a flow of coating material, a first control valve disposed on said handle portion, a first manually actuatable member which is connected with said first control valve and is movable relative to said handle portion to move said first control valve relative to said handle portion to vary the rate of flow of air through said first air passage, a second air passage extending from said handle portion to conduct a second flow of air which is directed through said second plurality of openings in said nozzle to control the configuration of a flow of atomized coating material from said nozzle, a second control valve disposed on said handle portion, a second manually actuatable member which is connected with said second control valve and is movable relative to said handle portion to move said second control valve relative to said handle portion to vary the rate of flow of air through said second air passage, a main air supply passage disposed in said handle portion and connecting said air conduit connector assembly in fluid communication with said first and second air passages, a main air flow control valve disposed on said handle portion, and a manually actuatable actuator member which is connected with said main air flow control valve and is movable relative to said handle portion to vary the rate of flow of air from said air conduit connector assembly to said first and second air passages.

26. An apparatus as set forth in claim 25 wherein said spray gun further includes a third control valve disposed on said handle portion and a third manually actuatable member which is connected with said third control valve and is movable relative to said handle portion to move said third control valve relative to said handle portion to vary the rate of flow of air through said second air passage while said second control valve is stationary relative to said handle portion.

27. An apparatus as set forth in claim 25 wherein said first control valve is disposed in and is movable axially along said first air passage by said first manually actuatable member, said second control valve being disposed in and movable axially along said second air passage by said second manually actuatable member.

28. An apparatus as set forth in claim 25 wherein said first control valve is disposed in said first air passage and has a central axis which is coincident with a central axis of said first air passage, said first manually actuatable member being rotatable about the central axis of said first control valve to move said first control valve axially along said first air passage, said second control valve being disposed in said second air passage and having a central axis which is coincident with a central axis of said second air passage, said second manually actuatable member being rotatable about the central axis of said second control valve to move said second control valve axially along said second air passage.

29. An apparatus as set forth in claim 21 wherein said coating material conduit conducts electrically charged coating material to said spray gun.

30. An apparatus for use in applying electrostatically charged coating material to an object, said apparatus comprising a spray gun having a handle portion and a nozzle connected with said handle portion to direct a flow of electrostatically charged coating material toward the object, said nozzle includes a first plurality of openings through which air is conducted to atomize a flow of coating material from said nozzle and a second plurality of openings through which air is conducted to control the configuration of a flow of atomized coating material from said nozzle, a coating material conduit through which coating material is conducted to said spray gun, an air conduit through which air is conducted to said spray gun, an air conduit connector assembly interconnecting said air conduit and said spray gun and through which air is conducted into said spray gun, a first air passage for conducting air to said first plurality of openings in said nozzle to atomize a flow of coating material from said nozzle, a first valve member disposed in said first air passage and movable axially along said first air passage to vary air flow rate through said first air passage, said first valve member having a central axis which extends axially along said first air passage, a first manually rotatable valve actuator member connected with said first valve member and rotatable about the central axis of said first valve member to move said first valve member axially along said first air passage, a second air passage for conducting air to said second plurality of openings in said nozzle to control the configuration of a flow of atomized coating material from said nozzle, a second valve member disposed in said second air passage and movable axially along said second air passage to vary air flow rate through said second air passage, said second valve member having a central axis which extends along said second air passage, a second manually rotatable valve actuator member connected with said second valve member and rotatable about the central axis of said second valve member to move said second valve member axially along said second air passage, a main air supply passage connecting said air conduit connector assembly in fluid communication with said first and second air passages, a main air flow control valve disposed in said main air supply passage and movable relative to said main air supply passage to vary air flow rate through said main air supply passage, and a manually engageable main air flow control member which is connected with said main air flow control valve and is movable relative to said handle portion to move said main air flow control valve and vary the rate of flow of air from said air conduit connector assembly to said first and second air passages.

31. An apparatus as set forth in claim 30 wherein said handle portion is electrically conductive, said air conduit includes an inner layer formed of an electrically conductive material and an outer layer formed of an electrically nonconductive material and extending around said inner layer to electrically insulate said inner layer, said air conduit connector assembly including a portion which is formed of a material which is electrically conductive and is connected with said inner layer of said air conduit and with said electrically conductive handle portion to electrically ground said electrically conductive handle portion through said second connector assembly and said inner layer of said air conduit.

32. An apparatus as set forth in claim 30 wherein said spray gun further includes a coating material flow control valve member which is movable relative to said nozzle to vary coating material flow rate through said nozzle, and a packing cartridge at least partially disposed in said spray gun and connected with said coating material flow control valve member and said main air flow control member to transmit force between said coating material flow control valve member and said main air flow control member to move said coating material flow control valve member relative to said nozzle, said spray gun including a chamber having a first end portion which tapers toward said nozzle and a second end portion which opens towards said main air flow control member, said packing cartridge being at least partially disposed in said chamber and having a tapered end portion which engages the first end portion of said chamber, said packing cartridge including an annular seal disposed on said tapered end portion of said packing cartridge and disposed in engagement with said first end portion of said chamber.

33. An apparatus as set forth in claim 30 wherein said air conduit connector assembly includes a conduit air flow control valve which is operable between an open condition and a closed condition, said conduit air flow control valve being effective to block flow of air from said air conduit when said conduit air flow control valve is in the closed condition, said conduit air flow control valve being ineffective to block flow of air from said air conduit when said conduit air flow control valve is in the open condition, said air conduit connector assembly including means for effecting operation of said conduit air flow control valve from the open condition to the closed condition upon disconnection of said air conduit from said spray gun, said air conduit connector assembly including means for effecting operation of said conduit air flow control valve from the closed condition to the open condition upon connection of said air conduit with said spray gun.

34. An apparatus as set forth in claim 30 wherein said handle portion of said spray gun is electrically conductive, said apparatus further including a coating material conduit connector assembly connecting said coating material conduit with said spray gun, said coating material conduit connector assembly includes a first component which is connected with said electrically conductive handle portion and a second component which is connected with said coating material conduit, said first and second components being formed of an electrically nonconductive material, one of said first and second components being telescopically received in the other of said first and second components when said coating material conduit is connected with said electrically conductive handle portion, said coating material conduit connector assembly including a rotatable sleeve which at least partially encloses said first and second components when said first and second components are telescopically interconnected.

35. An apparatus as set forth in claim 30 wherein said handle portion of said spray gun is electrically conductive, said apparatus includes a preformed fluid tube which is at least partially disposed in said electrically conductive handle portion, said fluid tube being formed of an electrically nonconductive material to electrically insulate coating material conducted through said fluid tube from said electrically conductive handle portion, said fluid tube being formed of a material which maintains a configuration to which it is preformed.

36. An apparatus as set forth in claim 30 wherein said spray gun further includes a third valve member disposed in said second air passage and rotatable about an axis extending transversely to a longitudinal axis of said second air passage to vary air flow rate through said second air passage, and a third manually rotatable valve actuator member connected with said third valve member and rotatable about an axis extending transversely to the longitudinal axis of said second air passage to rotate said third valve member in said second air passage.

37. An apparatus as set forth in claim 30 wherein said spray gun further includes a coating material flow control valve member which is movable relative to said nozzle to vary coating material flow rate through said nozzle, said manually engageable main air flow control member being connected with said coating material flow control valve member and being movable relative to said handle portion to move said coating material flow control valve member to vary the rate of flow of coating material.

38. A method of applying coating material to a workpiece with a spray gun, said method comprising the steps of electrically charging coating material, conducting the electrically charged coating material to the spray gun, charging a member in the spray gun under the influence of electrical energy in the electrically charged coating material, directing a spray of the electrically charged coating material from the spray gun toward the workpiece, and strengthening an electrostatic field between the spray gun and the workpiece with the electrical charge on the member while directing a spray of electrically charged coating material from the spray gun toward the workpiece.

39. A method as set forth in claim 38 further including the step moving the member between a closed position in which the member prevents spray of electrically charged coating material from the spray gun and an open position in which the member enables the spray of electrically charged coating material from the spray gun to be established.

40. A method as set forth in claim 38 further including the step of electrically isolating the member from ground while the spray of electrically charged coating material is directed from the spray gun toward the workpiece.

41. A method as set forth in claim 38 wherein said step of electrically charging coating material includes electrically charging the coating material at a source of the coating material, said step of conducting the electrically charged coating material to the spray gun includes conducting the electrically charged coating material through a conduit which is connected with the source of coating material and the spray gun.

42. A method as set forth in claim 38 further including the steps of maintaining an electrical connection between the spray gun and an electrical ground while directing a spray of electrically charged coating material from the spray gun toward the workpiece to electrically ground a portion of the spray gun and maintaining the member electrically isolated from the electrically grounded portion of the spray gun while directing a spray of electrically charged coating material toward the workpiece.

43. A method as set forth in claim 38 further including the steps of conducting a flow of air to the spray gun through an air conduit while directing a spray of electrically charged coating material from the spray gun toward the workpiece, and electrically grounding a portion of the spray gun through an electrical conductor disposed in the air conduit and connected with an electrical ground while directing a spray of electrically charged coating material from the spray gun toward the workpiece.

44. An electrostatic coating system for applying coating material to a workpiece, said electrostatic coating system comprising a spray gun, a source of electrically charged coating material, and conduit means for conducting electrically charged coating material from said source of electrically charged coating material to said spray gun, said spray gun including electrode means for receiving an electrical charge from the electrically charged coating material and strengthening an electrostatic field between said spray gun and the workpiece during application of coating material to the workpiece.

45. An electrostatic coating system as set forth in claim 44 further including means for moving said electrode means between a closed position in which said electrode means prevents spray of electrically charged coating material from said spray gun and an open position in which said electrode means enables a spray of electrically charged coating material to be directed from said spray gun toward the workpiece.

46. An electrostatic coating system as set forth in claim 44 further including means for electrically isolating said electrode means from ground during application of coating material to the workpiece.

47. An electrostatic coating system as set forth in claim 44 further including means for maintaining an electrical connection between said spray gun and an electrical ground to electrically ground a portion of said spray gun during application of coating material to the workpiece and means for maintaining said electrode means electrically isolated from the electrically grounded portion of said spray gun during application of coating material to the workpiece.

48. An electrostatic coating system as set forth in claim 44 further including air conduit connected with said spray gun to conduct a flow of air to said spray gun, said air conduit includes an electrical conductor connected with an electrical ground and with said spray gun to electrically ground said spray gun and electrically insulating material which extends around said electrical conductor and a passage through which air is conducted to said spray gun.

49. An apparatus for use in applying coating material to an object, said apparatus comprising a spray gun having a handle portion, an extension portion connected to and extending outward from said handle portion, and a nozzle connected with an end portion of said extension portion to direct a flow of coating material toward the object, a coating material conduit through which coating material is conducted to said spray gun, an air conduit through which air is conducted to said spray gun, a first air passage for conducting air from said handle portion through said extension portion to said nozzle, a first valve member disposed in said first air passage and movable axially along said first air passage to vary the air flow through said first air passage, said first valve member having a central axis which extends axially along said first air passage, a first manually rotatable valve actuator member connected with said first valve member and rotatable about the central axis of said first valve member to move said first valve member axially along said first air passage, said first actuator member being substantially enclosed within an opening in said handle portion, a second air passage for conducting air from said handle portion through said extension portion to said nozzle, a second valve member disposed in said second air passage and movable axially along said second air passage to vary the air flow through said second air passage, said second valve member having a central axis which extends along said second air passage, and a second manually rotatable valve actuator member connected with said second valve member and rotatable about the central axis of said second valve member to move said second valve member axially along said second air passage, said second actuator member being substantially enclosed within an opening in said handle portion.

50. An apparatus for use in applying coating material to an object, said apparatus comprising a spray gun having a handle portion, an extension portion connected to and extending outward from said handle portion, and a nozzle connected with an end portion of said extension portion to direct a flow of coating material toward the object, a coating material conduit through which coating material is conducted to said spray gun, an air conduit through which air is conducted to said spray gun, a first air passage for conducting air from said handle portion through said extension portion to said nozzle, a first valve member disposed in said first air passage and movable axially along said first air passage to vary the air flow through said first air passage, said first valve member having a central axis which extends axially along said first air passage, a first manually rotatable valve actuator member connected with said first valve member and rotatable about the central axis of said first valve member to move said first valve member axially along said first air passage, said first actuator member being substantially enclosed within an opening in said handle portion, a piston being installed on said first valve member between the air inlet into said first air passage and said actuator, said first member having an externally threaded portion, said actuator having an internally threaded portion threaded onto said threaded portion of said first valve actuator member, said first valve actuator member being rotatable to move said first valve member along said first air passage because of the force of said internal threads of said actuator against the external threads of said first valve member, and wherein said first valve member can automatically re-engage itself due to air pressure on the piston.

51. An apparatus for use in applying coating material to an object, said apparatus comprising a spray gun having a handle portion, an extension portion connected to and extending outward from said handle portion, and a nozzle connected with an end portion of said extension portion to direct a flow of coating material toward the object, a coating material conduit through which coating material is conducted to said spray gun, an air conduit through which air is conducted to said spray gun, a first air passage for conducting air from said handle portion through said extension portion to said nozzle, a first valve member disposed in said first air passage and movable axially along said first air passage to vary the air flow through said first air passage, said first valve member having a central axis which extends axially along said first air passage, a first manually rotatable valve actuator member connected with said first valve member and rotatable about the central axis of said first valve member to move said first valve member axially along said first air passage, said first actuator member being substantially enclosed within an opening in said handle portion, said first valve member has a nonround portion which is received within a nonround cavity in said handle to lock said valve member against rotation as said actuator is rotated.

52. An apparatus for use in applying coating material to an object, said apparatus comprising a spray gun having a handle portion, an extension portion connected to and extending outward from said handle portion, and a nozzle connected with an end portion of said extension portion to direct a flow of coating material toward the object, a coating material conduit through which coating material is conducted to said spray gun, an air conduit through which air is conducted to said spray gun, a first air passage for conducting air from said handle portion through said extension portion to said nozzle, a first valve member disposed in said first air passage and movable axially along said first air passage to vary the air flow through said first air passage, said first valve member having a central axis which extends axially along said first air passage, a first manually rotatable valve actuator member connected with said first valve member and rotatable about the central axis of said first valve member to move said first valve member axially along said first air passage, said first actuator member being substantially enclosed within an opening in said handle portion, and a shut-off valve installed within said first air passage between said first valve member and said nozzle.

* * * * *